US010431905B2

(12) United States Patent
Tonoike et al.

(10) Patent No.: US 10,431,905 B2
(45) Date of Patent: Oct. 1, 2019

(54) METHOD FOR CRIMPING CONNECTION STRUCTURE

(71) Applicants: FURUKAWA ELECTRIC CO., LTD., Tokyo (JP); FURUKAWA AUTOMOTIVE SYSTEMS, INC., Inukami-gun (JP)

(72) Inventors: Takashi Tonoike, Shiga (JP); Yukihiro Kawamura, Shiga (JP)

(73) Assignees: FURUKAWA ELECTRIC CO., LTD., Tokyo (JP); FURUKAWA AUTOMOTIVE SYSTEMS, INC., Inukami-gun (JP)

( * ) Notice: Subject to any disclaimer, the term of this patent is extended or adjusted under 35 U.S.C. 154(b) by 757 days.

(21) Appl. No.: 14/832,668

(22) Filed: Aug. 21, 2015

(65) Prior Publication Data

US 2015/0364833 A1 Dec. 17, 2015

Related U.S. Application Data

(63) Continuation of application No. PCT/JP2013/085204, filed on Dec. 27, 2013.

(30) Foreign Application Priority Data

Feb. 23, 2013 (JP) ..... 2013-033994

(51) Int. Cl.
*H01R 4/18* (2006.01)
*H01R 43/048* (2006.01)

(52) U.S. Cl.
CPC ..... *H01R 4/18* (2013.01); *H01R 4/183* (2013.01); *H01R 4/188* (2013.01); *H01R 43/048* (2013.01); *Y10T 29/4922* (2015.01)

(58) Field of Classification Search
CPC ..... H01R 43/048; H01R 4/18; H01R 13/00; H01R 4/183; G05B 23/02; G05B 9/02
See application file for complete search history.

(56) References Cited

U.S. PATENT DOCUMENTS 4,890,384 A * 1/1990 Shaffer ..... H01R 43/058 29/863
7,775,842 B2 * 8/2010 Yamagami ..... H01R 43/058 439/877

(Continued)

FOREIGN PATENT DOCUMENTS

JP 35-014168 B1 9/1960
JP 51-106882 U 8/1976

(Continued)

OTHER PUBLICATIONS

Office Action dated Aug. 15, 2017 in Japanese Patent Application No. 2014-115134 (with unedited computer generated English translation) 12 pages.

(Continued)

*Primary Examiner* — Minh N Trinh
(74) *Attorney, Agent, or Firm* — Oblon, McClelland, Maier & Neustadt, L.L.P.

(57) ABSTRACT

To provide a connection structure that can be crimped and connected in a desired crimping shape to the electric wire tip portion of an insulated wire without causing the deformation into an unintended crimping shape of the crimping portion of a crimp terminal. When crimping a conductor crimping portion (30*a*) of crimp terminal (10) to an electric wire tip portion (200*a*) of insulated wire (200), outer peripheral contact portions (613, 613) of a lower blade (61) of a crimping device (60A) and an outer peripheral contact portion (623) of an upper blade (62) are point-contacted to an outer periphery of a conductor crimping portion (30*a*) in a perpendicular cross section in a direction perpendicular to (Continued)

a longitudinal direction X and to a crimping direction Z so as to be left-right symmetrical with respect to a reference plane formed by the longitudinal direction (x) and the crimping direction (Z).

10 Claims, 14 Drawing Sheets

(56) References Cited

U.S. PATENT DOCUMENTS

| | | | | |
|---|---|---|---|---|
| 8,245,396 | B2 * | 8/2012 | Kondo | H01R 4/185 174/84 R |
| 9,543,726 | B2 * | 1/2017 | Sugimoto | H01R 43/048 |
| 9,768,526 | B2 * | 9/2017 | Kawamura | H01R 43/048 |

FOREIGN PATENT DOCUMENTS

| | | | |
|---|---|---|---|
| JP | 07-037670 | A | 2/1995 |
| JP | 2002-124310 | A | 4/2002 |
| JP | 3514168 | B2 | 3/2004 |
| JP | 2005-327690 | A | 11/2005 |
| JP | 2007-520037 | A | 7/2007 |
| JP | 2012-48833 | A | 3/2012 |
| JP | 2012-048833 | A | 3/2012 |
| JP | 2013-30274 | A | 2/2013 |
| JP | 2013-134910 | A | 7/2013 |
| WO | WO 2013/014955 | A1 | 1/2013 |

OTHER PUBLICATIONS

Office Action dated Feb. 8, 2018 in Japanese Patent Application No. 2014-115134 (with unedited computer generated English translation) citing references AO-AQ therein, 6 pages.

Combined Office Action and Search Report dated Feb. 4, 2017 in Chinese Patent Application No. 201380073600.4 (with unedited computer generated English translation of the Office Action and English translation of Categories of Cited Documents).

Notification of Reasons for Refusal drafted on Mar. 28, 2014 in Japanese Patent Application No. 2014-506659 (with unedited computer generated English translation).

Decision to Grant a Patent drafted on May 13, 2014 in Japanese Patent Application No. 2014-506659 (with unedited computer generated English translation).

International Search Report dated Mar. 25, 2014 in PCT/JP2013/085204 filed Dec. 27, 2013 with English translation.

Notice of Allowance issued in corresponding Chinese Application No. 201380073600.4 dated Jun. 21, 2017 (with English translation).

Decision to Grant dated Sep. 20, 2018 in Japanese Patent Appiication No. 2014-115134 (with English translation), 6 pages.

* cited by examiner

METHOD FOR CRIMPING CONNECTION STRUCTURE

TECHNICAL FIELD

The present invention relates to a connection structure configured to attach to a connector or the like provided for connection of a wire harness for an automobile, a terminal crimping member, a wire harness, a connector, a method for crimping a connection structure, and a crimping device for crimping the same.

BACKGROUND ART

Electric equipment mounted to an automobile or the like is connected to other electric equipment or a power device via wire harnesses that include insulated wires in a bundle, forming an electric circuit. The wire harnesses and electric equipment or the power device are connected through connectors attached thereto.

Various crimp terminals provided in the connectors described above have been proposed, and the crimp terminal disclosed in Patent Document 1 is one such crimp terminal.

A crimp terminal 81 disclosed in Patent Document 1 is a closed-barrel type crimp terminal 81 as illustrated in FIG. 14, wherein a conductor 83 exposed on a tip side of an insulated wire 82 is inserted into a crimping portion 81a having a substantially cylindrical shape of the crimp terminal 81, and then the crimping portion 81a is deformed in a contracting direction and crimped and connected to the conductor 83.

However, when the crimping portion 81a having a substantially cylindrical shape such as described above is deformed by a lower blade 71 and an upper blade 72 of a crimping device 70 illustrated in FIG. 14A, for example, the lower blade 71 and the upper blade 72 are point-contacted in a radial direction to an outer periphery of the crimping portion 81a to pressurize, causing an increase in the level of difficulty in aligning a crimping direction Z in which the lower blade 71 and the upper blade 72 pressurize the crimping portion 81a with a vertical virtual reference line that passes through a center portion P in a radial direction of the crimping portion 81a, in proportion to a circularity and a hardness of the crimping portion 81a, and the crimping portion 81a to rotationally move in a direction illustrated by a long dashed double-short dashed line in FIG. 14A by just a slight horizontal displacement of the center portion P in the radial direction of the crimping portion 81a. As a result, when the crimping portion 81a is deformed, twisting readily occurs on the crimping portion 81a, and the crimping portion 81a cannot be crimped and connected in the desired crimping shape (refer to FIG. 14B).

Further, when twisting occurs on the crimping portion 81a, stress collects in the twisted portion, causing an increase in the possibility of breakage, cracks, and the like, and resulting in the concern that the desired connection strength cannot be ensured. Furthermore, with the twisting of the crimping portion 81a, a portion of the crimping portion 81a protrudes significantly toward a direction perpendicular to a longitudinal direction of the crimping portion 81a. When the protruding portion protrudes a large amount and the crimp terminal 81 to which the insulated wire 82 is connected is inserted into a terminal insertion hole of a connector, the protruding portion of the crimping portion 81a abuts against an area near an inlet or an inner wall of the terminal insertion hole, hindering insertion. This hindering insertion makes it difficult to insert the crimp terminal 81 to a predetermined position inside the terminal insertion hole, and causes the insertion properties of the connector into the terminal insertion hole to deteriorate.

CITATION LIST

Patent Literature

Patent Document 1: Japanese Unexamined Patent Application Publication No. H7-37670A

SUMMARY OF THE INVENTION

Technical Problem

Therefore, an object of the present invention is to provide a connection structure that can be deformed into a desired crimping shape and crimped and connected to an electric wire tip portion of an insulated wire without causing the deformation into an unintended crimping shape of a crimping portion of a crimp terminal, a terminal crimping member, a wire harness, a connector, a method for crimping a connection structure, and a crimping device for crimping the same.

Solution to Problem

The present invention provides a method for crimping a connection structure and a crimping device for crimping the same. The method includes the steps of inserting an electric wire tip portion of an insulated wire, the electric wire tip portion being formed by exposing a conductor by peeling off an insulating covering of a tip side, into a crimping portion of a hollow cross section that includes an internal space that allows insertion of the electric wire tip portion in a crimp terminal, deforming the crimping portion by movement in a crimping direction of an arranged pair of terminal pressurization members, and crimping and connecting the insulated wire and the crimp terminal. Outer peripheral contact portions are provided to the terminal pressurization members. The outer peripheral contact portions contact an outer periphery of the crimping portion in a perpendicular cross section in a direction perpendicular to a longitudinal direction and to a crimping direction of the crimping terminal. First outer peripheral contact portions of essentially a first terminal pressurization member of the arranged pair of the terminal pressurization members are disposed at a spacing in a width direction of the crimping portion in the perpendicular cross section. The first outer peripheral contact portions are disposed so that contacting locations of the outer periphery of the crimping portion and the first outer peripheral contact portions are symmetrical with respect to a reference plane formed by the longitudinal direction and the crimping direction when the arranged pair of the terminal pressurization members is moved in the crimping direction to deform the crimping portion. Second outer peripheral contact portions are provided to a second terminal pressurization member of the arranged pair of the terminal pressurization members, the second outer peripheral contact portions point-contacting the outer periphery of the crimping portion in the perpendicular cross section. The second outer peripheral contact portions are disposed at a spacing in the width direction of the crimping portion in the perpendicular cross section. The second outer peripheral contact portions are disposed so that contacting locations of the outer periphery of the crimping portion and the second outer peripheral contact portion are symmetrical with respect to the reference plane when the crimping portion is deformed. The second outer peripheral contact portions of the second terminal pressurization member are disposed inward of the first outer peripheral contact portions of the first terminal pressurization member.

Here, the crimp terminal may include a closed-barrel female type crimp terminal or male type crimp terminal, for example. Further, the crimping portion may include a wire barrel that is crimped to the conductor tip portion of the insulated wire formed by exposing the conductor by peeling off the insulating covering of the tip side, and an insulation barrel that is crimped to the insulating covering of the tip side where the conductor is exposed, for example.

Further, the crimping portion may include a copper-based material, such as copper or a copper alloy. Further, the conductor may include aluminum wires or aluminum alloy wires, copper wires or copper alloy wires, aluminum wires having an outer peripheral surface covered by copper, or an appropriate metal wire having conductivity.

According to the present invention, it is possible to deform, crimp, and connect the crimping portion in a desired crimping shape to an electric wire tip portion of an insulated wire without causing the deformation into an unintended crimping shape of a crimping portion of a crimp terminal.

Specifically, when a pair of terminal pressurization members is moved in a crimping direction to deform the crimping portion of the crimp terminal, the outer peripheral contact portions are contacted so that contacting locations of an outer periphery of the crimping portion and the outer peripheral contact portions of the terminal pressurization member are symmetrical with respect to a reference plane formed by a longitudinal direction of and a crimping direction of the crimp terminal.

That is, during an initial period of the crimping operation in which the crimping portion is deformed by the pair of terminal pressurization members, resistance resulting from the contact of the outer peripheral contact portions is symmetrically applied to the outer periphery of the crimping portion, in a direction in which a rotation about a center portion in a radial direction of the crimping portion is suppressed, thereby making it possible to prevent the crimping portion from rotating or twisting and thus continually ensure a constant crimping behavior. Furthermore, the crimping portion is regulated between the symmetrically disposed outer peripheral contact portions, making it possible to prevent displacement of the orientation and position of the crimping portion.

With this arrangement, when the crimping portion is crimped and connected to the electric wire tip portion, the crimping portion can be deformed into a desired shape and crimped and connected to the electric wire tip portion of the insulated wire without the occurrence of twisting or the like on the crimping portion. As a result, stable conductivity can be ensured.

Furthermore, the crimp terminal to which the insulated wire is connected can be reliably inserted to a predetermined position inside the terminal insertion hole of the connector, for example, thereby achieving stable insertion characteristics.

Furthermore, because the crimping portion is deformed into a desired crimping shape and crimped and connected to the electric wire tip portion, gaps are less likely to occur between the crimping portion and the electric wire tip portion, making it possible to ensure a waterproof performance.

According to an aspect of the present invention, it is possible to provide an outer peripheral contact portion that point-contacts an outer periphery of a center portion in the width direction of the crimping portion in the perpendicular cross section to the second terminal pressurization member of the arranged pair of terminal pressurization members, and dispose the outer peripheral contact portion so that contacting locations of an outer periphery of the crimping portion and the outer peripheral contact portion are symmetrical with respect to the reference plane when the arranged pair of terminal pressurization members is moved in the crimping direction, thereby making it possible to more accurately and reliably deform, crimp, and connect the crimping portion of the crimp terminal in a desired crimping shape.

Specifically, when the pair of terminal pressurization members is moved in the crimping direction to deform the crimping portion of the crimp terminal, the outer peripheral contact portions are point-contacted so that the contacting locations of an outer periphery of the crimping portion and the outer peripheral contact portions of the other terminal pressurization member are symmetrical with respect to a reference plane so as to be on an outer periphery of a center portion in the width direction of the crimping portion in the perpendicular cross section.

That is, because the outer peripheral contact portions of the second terminal pressurization member are contacted to an outer periphery of the center portion in the width direction of the crimping portion so as to be symmetrical with respect to the reference plane, the number of locations that are symmetrically point-contacted to the outer periphery of the crimping portion is greater than the number when only the outer peripheral contact portions of first terminal pressurization member are contacted to the outer periphery of the crimping portion as described above, thereby increasing the resistance applied in a direction that suppresses the rotation of the crimping portion.

As a result, during the initial period of the crimping operation by which the crimping portion is deformed, the crimping portion is less likely to rotate, making it possible to more reliably crimp and connect the crimping portion of the crimp terminal and the electric wire tip portion of the insulated wire.

Further, according to an aspect of the present invention, it is possible to dispose the outer peripheral contact portion of the second terminal pressurization member so that it is inward of the outer peripheral contact portion of the first terminal pressurization member, thereby making it possible to suppress rotation of the crimping portion by the first and second outer peripheral contact portions of the first and second terminal pressurization members.

Specifically, the outer peripheral contact portions of the second terminal pressurization member are contacted to an outer periphery inward of the outer peripheral contact portions of the first terminal pressurization member. That is, the positional relationship between the resistance applying portion where resistance is applied by the contact of the outer peripheral contact portions of first terminal pressurization member and the resistance applying portion where resistance is applied by the contact of the outer peripheral contact portions of the second terminal pressurization member differ in the peripheral direction, making it possible to further suppress rotation of the crimping portion.

As a result, the effect of suppressing the rotation of the crimping portion is further increased, thereby improving the accuracy at which the crimping portion is deformed into a desired crimping shape.

Further, according to an aspect of the present invention, the first terminal pressurization member can include a receiving groove having the first outer peripheral contact portions, and the second terminal pressurization member can be configured in a convex shape that is narrower than the receiving groove.

Further, according to an aspect of the present invention, the movement in the crimping direction of the terminal pressurization members allows the second terminal pressurization member to press the crimping portion to the receiving groove and the crimping portion to decrease in diameter in the width direction by the receiving groove. Further, according to an aspect of the present invention, it is possible to provide a third outer peripheral contact portion disposed inward of the first outer peripheral contact portions of the first terminal pressurization member disposed at a spacing, on the receiving groove.

Further, according to an aspect of the present invention, the crimping portion can include a conductor crimping portion that is crimped to a conductor tip portion of a conductor exposed from an insulating covering of the insulated wire.

According to the present invention, it is possible to reliably crimp and connect the crimping portion of the crimp terminal to the conductor tip portion exposed on the tip side of the insulated wire, and ensure predetermined conductivity.

Further, the present invention provides a connection structure that connects the insulated wire and the crimp terminal by the crimping portion of the aforementioned crimp terminal.

According to the present invention, it is possible to configure a connection structure capable of ensuring stable conductivity.

Further, the present invention provides a connector in which the crimp terminal of the aforementioned connection structure is disposed inside a connector housing.

According to the present invention, it is possible to ensure a connection state having reliable conductivity.

Further, the present invention provides a wire harness in which the aforementioned connection structures are collected in a bundle and the crimp terminals of the connection structures are attached inside the connector housing.

According to the present invention, it is possible to configure a wire harness that ensures favorable conductivity using a connection structure that improves the conductivity of the crimp terminal and the insulated wire.

Effect of the Invention

According to the present invention, it is possible to provide the connection structure that can be deformed in a desired crimping shape, and crimped and connected to the electric wire tip portion of the insulated wire without causing the deformation into an unintended crimping shape of the crimping portion of the crimp terminal, the terminal crimping member, the wire harness, the connector, the method for crimping the connection structure, and the crimping device for crimping the same.

DESCRIPTION OF EMBODIMENTS

An embodiment of the present invention will now be described in detail on the basis of the drawings.

Working Example 1

Figure 1A:
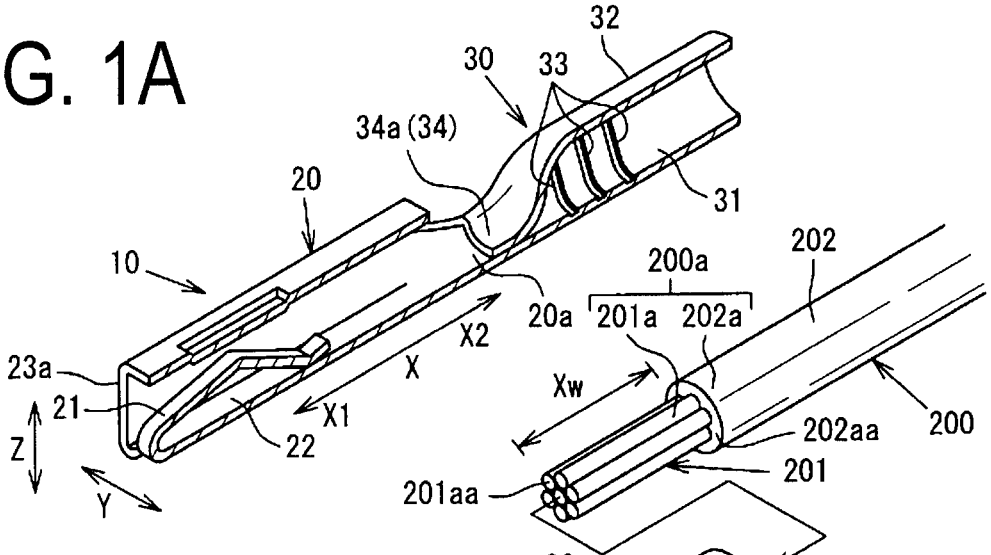
FIGS. 1A to 1C are explanatory views of a connection structure of this embodiment.
Figure 1B:
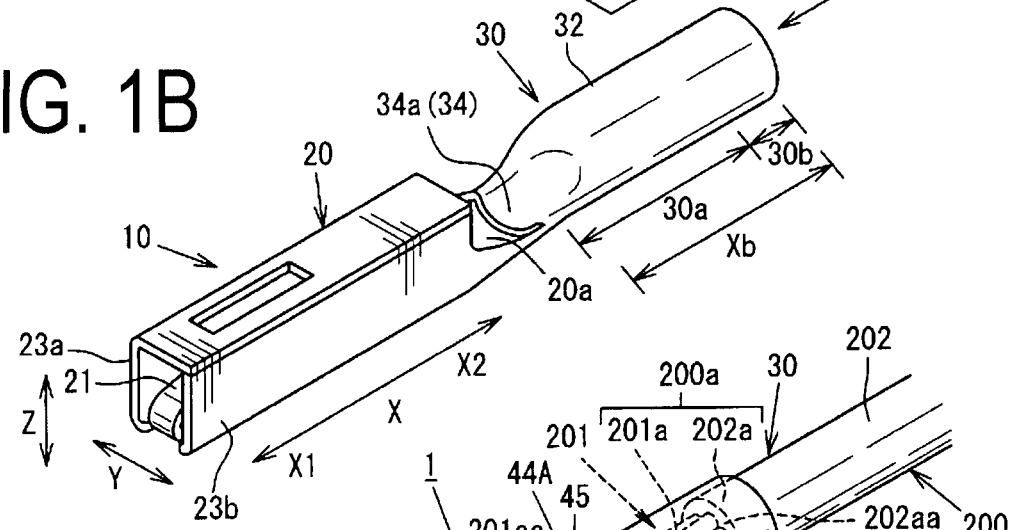
Figure 1C:
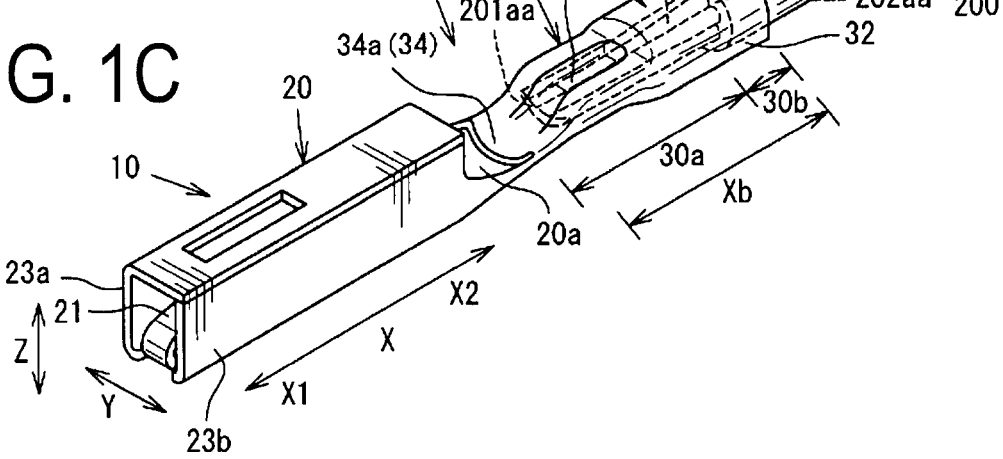

FIGS. 1A to 1C are explanatory views of a crimping connection structure 1 of this embodiment. Specifically, FIG. 1A is a longitudinal cross-sectional perspective view of a female type crimp terminal 10 divided at a center portion in a width direction Y before crimping, FIG. 1B is a perspective view illustrating the female type crimp terminal 10 and an insulated wire 200 before crimping, and FIG. 1C is a perspective view of the female type crimp terminal 10 and the insulated wire 200 after crimping, that is, the crimping connection structure 1.

Figure 2:
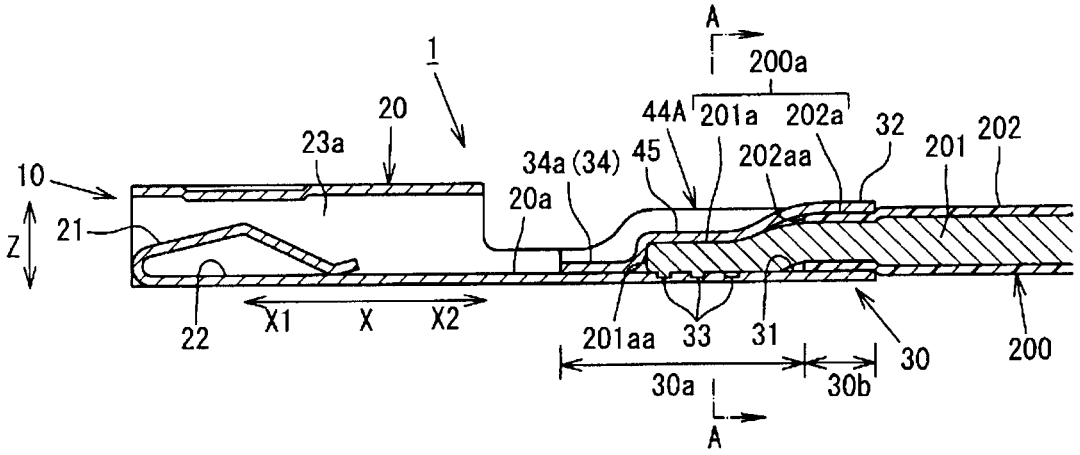
FIG. 2 is a longitudinal cross-sectional side view of the connection structure divided at the center in the width direction.
Figure 3A:
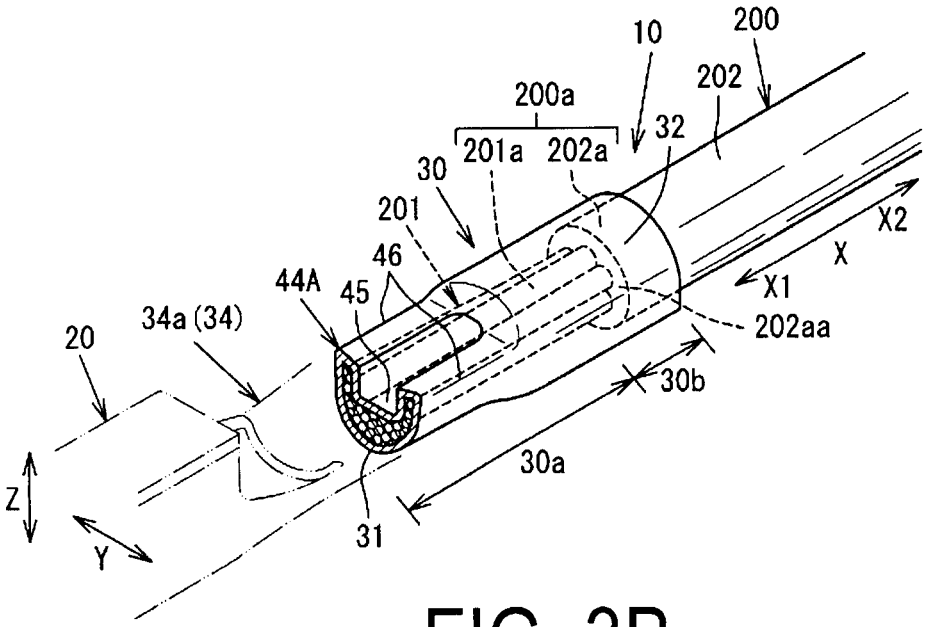
FIGS. 3A and 3B are explanatory views of a crimping portion of a crimping connection structure.
Figure 3B:
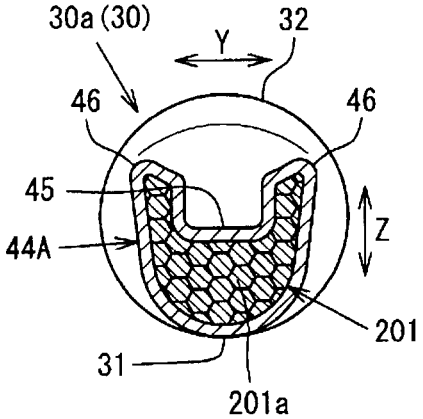

FIG. 2 is a longitudinal cross-sectional side view of the crimping connection structure 1 divided at the center portion in the width direction Y. FIGS. 3A and 3B are explanatory views of a crimping portion 30 of the crimping connection structure 1. Specifically, FIG. 3A is a perspective view of a crimping portion of the crimping connection structure 1 with a box portion 20 and a sealing portion 34 made transparent, and FIG. 3B is a cross-sectional view of a substantially U-shaped crimping portion 44A from an arrow direction of a line A-A, as viewed from a frontward side X1 in a longitudinal direction X illustrated in FIG. 2.

The crimping connection structure 1 of this embodiment is configured to connect the insulated wire 200 and the female type crimp terminal 10, as illustrated in FIGS. 1A to 1C and FIG. 2.

That is, a conductor tip portion 201*a* of the insulated wire 200, the conductor tip portion 201*a* being formed by exposing an aluminum core wire 201 by peeling off an insulating covering 202 of a tip side of an electric wire tip portion 200*a*, is configured to crimp and connect to the crimping portion 30 of the female type crimp terminal 10.

The insulated wire 200 crimped and connected to the aforementioned female type crimp terminal 10 is configured to cover an entire outer peripheral length of the aluminum core wire 201, which is formed by twisting a plurality of aluminum wires formed from an aluminum alloy into a bundle, by the insulating covering 202 formed of insulating resin.

The electric wire tip portion 200*a* is a section in which the conductor tip portion 201*a* of the aluminum core wire 201 and a cover tip portion 202*a* of the insulating covering 202 are disposed in series in this order toward the tip side, in the tip section of the insulated wire 200.

The female type crimp terminal 10, as illustrated in FIG. 1, integrally includes the box portion 20 that allows an insertion tab of a male type connector (not illustrated) to be inserted thereinto, and the crimping portion 30 that is disposed rearward from the box portion 20 via a transition portion 20*a* having a predetermined length, from the front or the tip side in the longitudinal direction X of the female type crimp terminal 10 toward the rear.

It should be noted that the aforementioned longitudinal direction X is the same as the longitudinal direction X of the insulated wire 200 to be connected to the crimping portion 30 by crimping, and the width direction Y intersects the longitudinal direction X in the planar direction.

A side of the box portion 20 across the crimping portion 30 is considered frontward, and conversely a side of the crimping portion 30 across the box portion 20 is considered rearward (refer to FIG. 1).

Specifically, the female type crimp terminal 10 is formed from a copper alloy (not illustrated) such as a brass having a tin-plated (Sn-plated) surface. The female type crimp terminal 10 is a closed-barrel type terminal made of the box portion 20 having a hollow quadrangular prism shape as viewed from the frontward side X1 in the longitudinal direction X, and the crimping portion 30 having a hollow cross section as viewed from a rearward side X2.

The crimping portion 30 of a male type crimp terminal (not illustrated) that includes an insertion tab, which is inserted into the box portion 20, is also formed with a similar structure (refer to FIG. 1).

It should be noted that the female type crimp terminal 10 is not limited to the copper alloy and may be formed from an aluminum alloy or a suitable metal or the like having conductivity.

The box portion 20 includes an elastic contact piece 21 in an inner area of the frontward side X1 having the hollow quadrangular prism shape. The elastic contact piece 21 is folded rearward in the longitudinal direction X and contacts the insertion tab (not illustrated) of the male type connector which is inserted into the box portion 20.

The box portion 20 includes side surface portions 23*a*, 23*b* that are provided along, and continuous from, both side portions of a bottom surface portion 22 in the width direction Y perpendicular to the longitudinal direction X, and are folded so as to overlap, thereby forming a generally rectangular shape as viewed from the frontward side X1 in the longitudinal direction X.

The crimping portion 30 before crimping includes a crimping bottom surface 31 provided along, and continuous from, a rear end of the bottom surface portion 22 of the box portion 20, and a substantially hollow shaped (barrel shaped) electric wire crimping portion 32 that, as viewed from the rearward side X2 in the longitudinal direction X, opens only on the rearward side X2, allowing insertion of the electric wire tip portion 200*a*, and not on the tip side or across the entire peripheral surface portion (refer to FIGS. 1A and 1B).

The crimping portion 30 includes an inner space that allows the cover tip portion 202*a* of the insulating covering 202 and the conductor tip portion 201*a* of the aluminum core wire 201 exposed from the cover tip portion 202*a* to be inserted thereinto.

A length Xb (refer to FIG. 1B) in the longitudinal direction of the crimping portion 30 is made longer than an exposed length Xw in the longitudinal direction X of the conductor tip portion 201*a* exposed frontward in the longitudinal direction X, from the cover tip portion 202*aa*, which is a frontward side tip in the longitudinal direction X of the insulating covering 202.

The crimping portion 30 includes a conductor crimping portion 30*a* that crimps the conductor tip portion 201*a* of the aluminum core wire 201, and a cover crimping portion 30*b* that crimps the insulating covering 202. The conductor crimping portion 30*a* and the cover crimping portion 30*b* are formed integrally in this order, continuously in series, from the frontward side X1 toward the rearward side X2. An inner periphery of the crimping portion 30 has a peripheral length and a shape conformed to an outer diameter of the insulating covering 202.

The conductor crimping portion 30*a* is a section corresponding to the conductor tip portion 201*a* on the frontward side X1 in the longitudinal direction X of the aluminum core wire 201, in the state in which the electric wire tip portion 200*a* is inserted into the crimping portion 30, and is formed in a hollow shape that can surround the conductor tip portion 201*a*.

The cover crimping portion 31*b* is a section corresponding to the cover tip portion 202*a* on the frontward side X1 in the longitudinal direction X of the insulating covering 202, in a state in which the electric wire tip portion 200*a* is inserted into the crimping portion 30, and is formed in a hollow shape that can surround the cover tip portion 202*a*.

It should be noted that the conductor crimping portion 30*a* and the cover crimping portion 31*b* are barrel shaped having diameters substantially equal to each other in the state before crimping.

Furthermore, three serrations 33 are formed on an inner surface of the conductor crimping portion 30*a* at a predetermined spacing in the longitudinal direction X. The serrations 33 extend along the inner periphery of the conductor crimping portion 30*a*. The aluminum core wire 201 penetrates into the serrations 33 in the state of being crimped.

The serrations 33 are formed in a groove shape that continues from the crimping bottom surface 31 of the crimping portion 30 to the inner periphery of the electric wire crimping portion 32 on both sides in the width direction Y (refer to FIG. 1A).

Further, the sealing portion 34 that causes the inner surfaces of the crimping portion 30 to be brought into tight contact with each other and hinder entry of moisture from the front into the inner space of the crimping portion 30 is formed in a tip section of the crimping portion 30.

The sealing portion 34 is formed as follows. The tip side of the crimping portion 30 that protrudes frontward from a tip 201*aa* of the conductor tip portion 201*a* is deformed into a flat shape so as to be flattened in the vertical direction, such that an inner surface of the crimping bottom surface 31 and an inner surface of the electric wire crimping portion 32 of the crimping portion 30 facing each other are brought into tight contact, and then welded by laser in the width direction (welded by a fiber laser, for example).

Furthermore, the sealing section deformed into a flat shape and welded by laser is deformed into a substantially U-shaped cross section by use of a blade member such as a crimper jig (not illustrated). As a result, a concave shape sealing portion 34*a* having a substantially U-shaped cross section which is wide in the width direction Y as viewed from the frontward side X1 in the longitudinal direction X is formed (refer to FIGS. 1B and 2).

It should be noted that, after formation, the concave shape sealing portion 34*a* may be welded by laser or left deformed in a flat shape as is without further formation.

Now, the crimping connection structure 1 configured by crimping and connecting the crimping portion of the female type crimp terminal 10 configured as described above and the insulated wire 200 will be described.

As described above, in the crimping connection structure 1, the aluminum core wire 201 of the insulated wire 200 is crimped and connected to the crimping portion of the aforementioned female type crimp terminal 10 (refer to FIGS. 1A to 1C and FIGS. 3A and 3B).

Specifically, the electric wire tip portion 200*a* of the insulated wire 200 is inserted into the crimping portion 30 of the female type crimp terminal 10 so that, in the longitudinal direction X, the tip 201*aa* of the conductor tip portion 201*a* of the aluminum core wire 201 that is exposed on the tip side from the insulating covering 202 of the insulated wire 200 is located rearward from the sealing portion 34 of the crimping portion 30.

At this time, the length Xb (refer to FIGS. 1B and 1C) in the longitudinal direction of the crimping portion 30 is made longer than the exposed length Xw, in the longitudinal direction X, of the conductor tip portion 201*a* exposed frontward in the longitudinal direction X (refer to FIG. 1A) from the cover tip portion 202*aa*, which is a tip on the frontward side in the longitudinal direction X of the insulating covering 202.

As a result, the electric wire tip portion 200*a* of the insulated wire 200 is inserted into the crimping portion 30, from the tip 201*aa* of the conductor tip portion 201*a* to the rearward side X2 of the cover tip portion 202*aa* of the insulating covering 202.

Figure 4A:
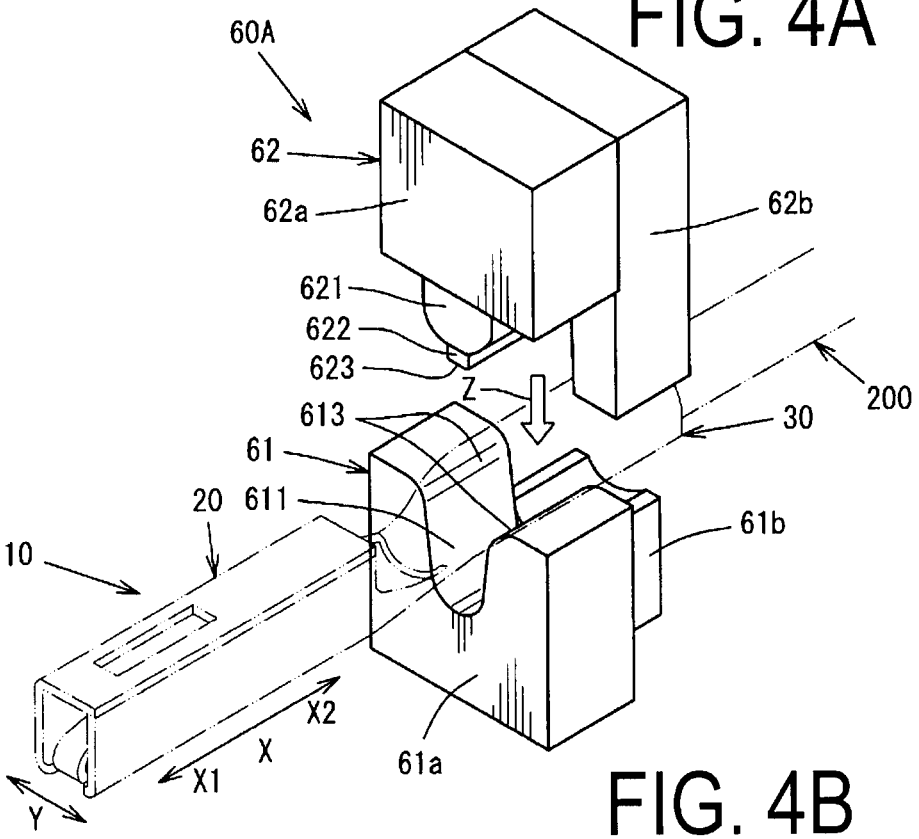
FIGS. 4A and 4B are explanatory views of a first crimping device.
Figure 4B:
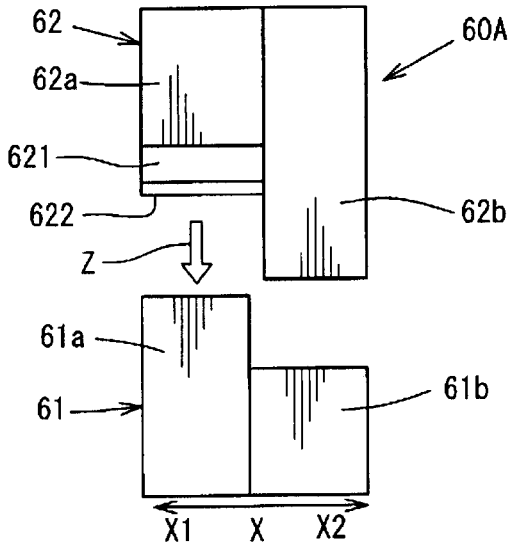

After the cover tip portion 202*aa* of the electric wire tip portion 200*a* is inserted to the predetermined position inside the crimping portion 30, the entirety of the crimping portion 30 is pressurized and deformed in a contracting direction by a first crimping device 60A illustrated in FIGS. 4A and 4B so that the electric wire tip portion 200*a* of the insulated wire 200 and the conductor tip portion 201*a* of the aluminum core wire 201 are covered. Thus, the crimping portion 30 and the aluminum core wire 201 are crimped and connected to each other.

At this time, the crimping portion 30 forms the substantially U-shaped crimping portion 44A having a substantially U-shaped cross section as viewed from the frontward side X1 in the longitudinal direction X, on the rearward side X2 of the aforementioned sealing portion 34 (refer to FIGS. 1C and 2).

The substantially U-shaped crimping portion 44A, as illustrated in FIGS. 3A and 3B, has a lower surface side that includes the crimping bottom surface 31 of the crimping portion 30 and is formed in the shape of a convex, arced cross section, and includes a concave portion 45 having a center portion in the width direction Y on the upper surface side that is indented into a concave cross section, and a protruding portion 46 that protrudes toward the upper surface side on both side portions in the width direction Y of the concave portion 45.

The first crimping device 60A that crimps the crimping portion 30 so as to become the substantially U-shaped crimping portion 44A such as described above includes a lower blade 61 that pressurizes a lower side outer periphery of the crimping portion 30 of the female type crimp terminal 10, and an upper blade 62 that pressurizes an upper side outer periphery of the crimping portion 30, as illustrated in FIGS. 4A and 4B and FIGS. 5A and 5B.

FIG. 4A to 4C are explanatory views of the first crimping device 60A. Specifically, FIG. 4A is a perspective view of the crimping device 60A, and FIG. 4B is a side view of the crimping device 60A.

Figure 5A:
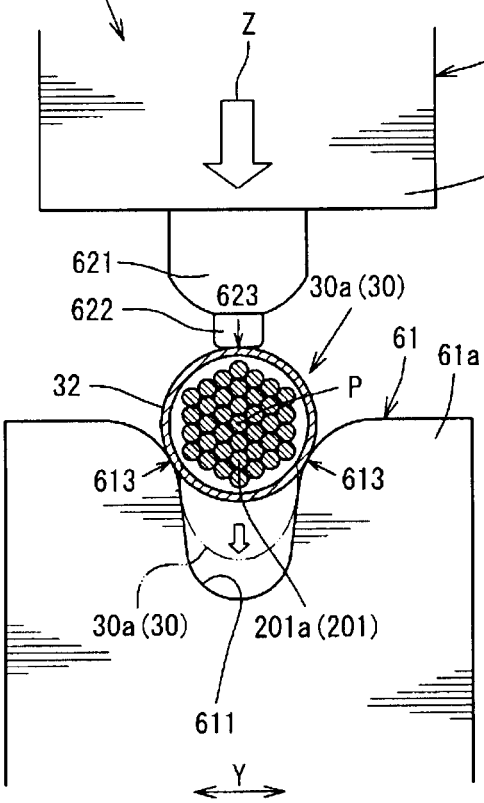
FIGS. 5A and 5B are explanatory views of a method for crimping a crimping portion by the first crimping device.
Figure 5B:
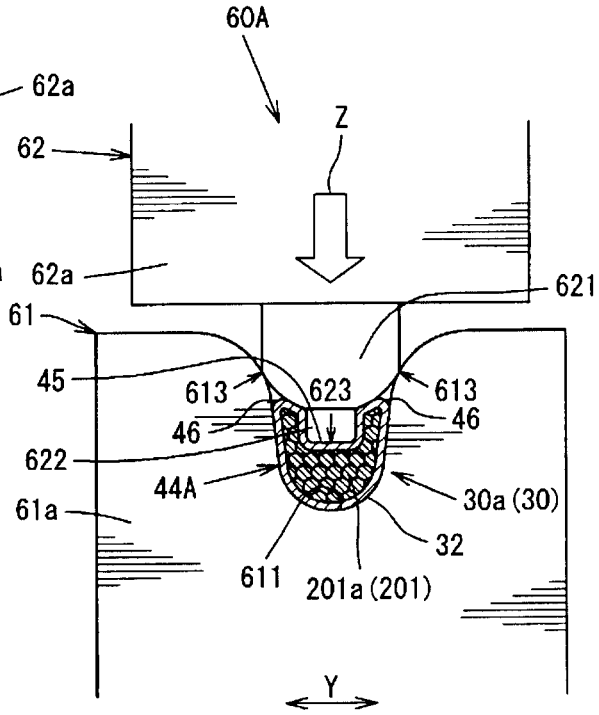

FIGS. 5A and 5B are explanatory views of the method for crimping the crimping portion 30 by the crimping device 60A. Specifically, FIG. 5A is a schematic view during the initial period of the crimping operation by which the crimping portion 30 is deformed by the crimping device 60A, and FIG. 5B is a schematic view of the crimping portion 30 deformed, crimped, and connected by the crimping device 60A.

The lower blade 61 includes a front-side receiving portion 61*a* having a substantially U-shaped cross section that deforms the lower side outer periphery of the conductor crimping portion 30*a* of the crimping portion 30, and a rear-side receiving portion 61*b* having a substantially U-shaped cross section that deforms the lower side outer periphery of the cover crimping portion 30*b*. The front-side receiving portion 61*a* and the rear-side receiving portion 61*b* are disposed on the frontward side X1 and the rearward side X2 in the longitudinal direction X (refer to FIGS. 4A and 4B).

A receiving groove 611 having a substantially U-shaped cross section is formed, facing downward, on the front-side receiving portion 61*a*. The receiving groove 611 is for contracting and deforming the conductor crimping portion 30*a* of the crimping portion 30 with the conductor tip portion 201*a* of the aluminum core wire 201 inserted thereinto.

The receiving groove 611 is formed to have a groove width that gradually widens from the downward side to the upward side in a crimping direction Z in which the crimping portion 30 is crimped in the radial direction, and into a groove shape so as to be left-right symmetrical with respect to a reference plane formed by the longitudinal direction X and the crimping direction Z of the female type crimp terminal 10 (refer to FIGS. 4A and 5A).

It should be noted that the area between the upper end portions of both side portions in the width direction Y of the receiving groove 611 is set at a spacing that is narrower than the maximum outer diameter of the conductor crimping portion 30*a* having a substantially hollow shape before pressurization.

An outer peripheral contact portion 613 is formed on each of the upper end portions of both side portions in the width direction Y of the receiving groove 611. These outer peripheral contact portions 613 are point-contacted to the lower side outer periphery of the conductor crimping portion 30*a* of the crimping portion 30 in a perpendicular cross section perpendicular to the longitudinal direction X and to the crimping direction Z of the female type crimp terminal 10 so as to be left-right symmetrical with respect to the reference plane (refer to the long dashed double-short dashed line in FIG. 4, and FIG. 5A).

These outer peripheral contact portions 613 have a smooth curved surface as viewed from the frontward side X1 in the longitudinal direction X, and are therefore point-contacted to the lower side outer periphery of the conductor crimping portion 30*a* so as to be left-right symmetrical during the initial period of the crimping operation by which the conductor crimping portion 30*a* of the crimping portion 30 is pressurized.

Further, the outer peripheral contact portions 613 are disposed at a spacing so as to be point-contacted to the lower side outer periphery of the conductor crimping portion 30*a* of the crimping portion 30 in the perpendicular cross section in a left-right symmetrical manner, and disposed so that the contacting locations of the lower side outer periphery of the conductor crimping portion 30*a* and the outer peripheral contact portions 613 on both side portions in the width direction Y are left-right symmetrical with respect to the reference plane (refer to FIG. 5A).

The upper blade 62 includes a front-side pressurizing portion 62*a* having a substantially convex cross section that deforms the upper side outer periphery of the conductor crimping portion 30*a*, and a rear-side pressurizing portion 62*b* having a substantially inverted U-shaped cross section that deforms an upper side outer periphery of the cover crimping portion 30*b*. The front-side pressurizing portion 62*a* and the rear-side pressurizing portion 62*b* are disposed on the frontward side X1 and the rearward side X2 in the longitudinal direction X.

A protruding portion 621 having a substantially convex cross section for deforming the upper side outer periphery of the conductor crimping portion 30*a* into a concave cross section protrudes downward from the front-side pressurizing portion 62*a*.

A concave forming portion 622 for forming the aforementioned concave portion 45 on the upper side outer periphery of the center portion in the width direction Y of the conductor crimping portion 30*a* in the perpendicular cross section protrudes downward in a convex state from a lower end portion of the center portion in the width direction Y of the protruding portion 621.

The concave forming portion 622 has a convex shape that is left-right symmetrical with respect to the reference plane, and is formed so as to be narrower than the aforementioned receiving groove 611 and protruding portion 621, having a length, width, and height by which the aforementioned concave portion 45 is formed.

An outer peripheral contact portion 623 is formed in one location on a lower end portion of a center portion of the concave forming portion 622 in the width direction Y. This outer peripheral contact portion 623 is point-contacted to the upper side outer periphery of the conductor crimping portion 30*a* of the crimping portion 30 in the perpendicular cross section so as to be left-right symmetrical with respect to the reference plane.

The aforementioned protruding portion 621 and concave forming portion 622 are formed to have a length corresponding to the longitudinal direction X of the conductor crimping portion 30*a* to be crimped.

That is, when the conductor crimping portion 30*a* is crimped, the concave forming portion 622 and the outer peripheral contact portion 623 are point-contacted and line-contacted in the longitudinal direction X to the upper side outer periphery of the center portion in the width direction Y of the conductor crimping portion 30*a* in the perpendicular cross section so as to be left-right symmetrical (refer to FIG. 5A).

The outer peripheral contact portion 623 has a smooth flat surface as viewed from the frontward side X1 in the longitudinal direction X, and is point-contacted to the upper side outer periphery on a perpendicular virtual reference line that passes through a center portion P in the radial direction of the conductor crimping portion 30*a* so as to be left-right symmetrical during the initial period of the crimping operation by which the conductor crimping portion 30*a* is pressurized (refer to FIG. 5A).

When the female type crimp terminal 10 and the insulated wire 200 are energizably crimped and connected using the crimping device 60A configured as described above, the electric wire tip portion 200*a* of the insulated wire 200 is inserted to a predetermined position inside the crimping portion 30 of the female type crimp terminal 10 in advance (refer to FIG. 2B).

The crimping portion 30 into which the electric wire tip portion 200*a* is inserted is retained by the lower blade 61 and the upper blade 62 (refer to FIG. 5A), and subsequently the lower blade 61 and the upper blade 62 are moved in the crimping direction Z, thereby crimping and connecting the crimping portion 30 of the female type crimp terminal 10 to the electric wire tip portion 200*a* of the insulated wire 200.

That is, the conductor crimping portion 30*a* of the crimping portion 30 is contracted in the width direction Y while pressed inside the receiving groove 611 of the lower blade 61, deforming into a substantially elliptic shape (refer to the long dashed double-short dashed line in FIG. 5A).

Furthermore, the conductor crimping portion 30*a* is deeply pressed to a position that reaches the bottom surface portion of the receiving groove 611, and is deformed into a crimping shape such as the substantially U-shaped crimping portion 44A (refer to FIG. 5B).

With this arrangement, the conductor crimping portion 30*a* of the crimping portion 30 is deformed into a crimping shape such as the substantially U-shaped crimping portion 44A, making it possible to reliably crimp and connect the conductor crimping portion 30*a* to the conductor tip portion 201*a* of the aluminum core wire 201 exposed from the insulating covering 202 on the tip side of the electric wire tip portion 200*a* of the insulated wire 200 (refer to the cross section as viewed from the longitudinal direction X in FIG. 3B).

Meanwhile, the cover crimping portion 30*b* of the crimping portion 30 is pressurized and deformed by the rear-side receiving portion 61*b* of the lower blade 61 and the rear-side pressurizing portion 62*b* of the upper blade illustrated in FIGS. 4A and 4B, and crimped and connected to the cover tip portion 202*a* of the insulating covering 202.

With this arrangement, it is possible to more firmly crimp and connect the female type crimp terminal 10 and the insulated wire 200 while ensuring waterproof performance, and to manufacture the crimping connection structure 1 in which the female type crimp terminal 10 and the insulated wire 200 are crimped and connected, that is, an electric wire with a terminal.

Specifically, when the crimping portion 30 is retained by the lower blade 61 and the upper blade 62, the conductor crimping portion 30*a* of the crimping portion 30 is received by the front-side receiving portion 61*a* of the lower blade 61.

At this time, the outer peripheral contact portions 613, 613 of the receiving groove 611 in the front-side receiving portion 61*a*, serving as first contacted sections, are point-contacted in two locations to the lower side outer periphery of the conductor crimping portion 30*a* in the perpendicular cross section so as to be left-right symmetrical manner with respect to the reference plane, and each outer peripheral contact portion 613 is line-contacted in the longitudinal direction X along the lower side outer periphery of the conductor crimping portion 30*a* (refer to FIG. 5A).

The upper blade 62 is then moved in the crimping direction Z, pressing the concave forming portion 622 of the protruding portion 621 of the front-side pressurizing portion 62*a* of the upper blade 62 to the upper side outer periphery of the center portion in the width direction Y of the conductor crimping portion 30*a* in the perpendicular cross section.

The outer peripheral contact portion 623 of the concave forming portion 622 is point-contacted in one location to the upper side outer periphery of the center portion in the width direction Y of the conductor crimping portion 30*a*, and line-contacted in the longitudinal direction X along the upper side outer periphery of the conductor crimping portion 30*a* (refer to FIG. 5A).

Next, during the initial period of the crimping operation by which the lower blade 61 and the upper blade are moved in the crimping direction Z to deform the conductor crimping portion 30*a*, resistance resulting from the point contacts and the line contact in the longitudinal direction X of the outer peripheral contact portions 613, 613 of the lower blade 61, resistance resulting from the point contact and the line contact in the longitudinal direction X of the outer peripheral contact portion 623 of the upper blade 62, and resistance resulting from the outer peripheral contact portions 613, 623 penetrating the vertical outer periphery of the conductor crimping portion 30*a* are applied to the outer periphery of the conductor crimping portion 30*a* with left-right symmetry.

The aforementioned resistances are applied with left-right symmetry in a direction in which a rotation about the center portion P in the radial direction of the conductor crimping portion 30*a* in the perpendicular cross section is suppressed, making it possible to prevent displacement of the orientation and position of the conductor crimping portion 30*a*.

With this arrangement, even when the circularity and hardness of the conductor crimping portion 30*a* are high, it is possible to prevent the crimping portion 30 and the conductor crimping portion 30*a* from rotating or twisting about the center portion P in the radial direction during the initial period of the crimping operation by which the conductor crimping portion 30*a* is deformed, thereby continually ensuring a constant crimping behavior.

Moreover, the crimping portion 30 is regulated between the outer peripheral contact portions 613, 613 disposed with left-right symmetry, making it possible to prevent displacement of the orientation and position of the crimping portion 30 and the conductor crimping portion 30*a*.

Furthermore, when the conductor crimping portion 30*a* of the crimping portion 30 is crimped and connected to the conductor tip portion 201*a* of the aluminum core wire 201, it is possible to deform the conductor crimping portion 30*a* into a desired crimping shape without causing rotation, twisting, or the like in the crimping portion 30 or the conductor crimping portion 30*a*, making it possible to reliably crimp and connect the conductor crimping portion 30*a* to the conductor tip portion 201*a* of the aluminum core wire 201 (refer to FIG. 5B). As a result, it is possible to ensure stable conductivity.

Furthermore, the outer peripheral contact portions 613, 613 of the lower blade 61 and the outer peripheral contact portion 623 of the upper blade 62 are point-contacted in three locations and line-contacted in the longitudinal direction X to the peripheral surface of the conductor crimping portion 30*a*.

With this arrangement, there are more locations that are point-contacted and line-contacted to the peripheral surface of the conductor crimping portion 30*a* with left-right symmetry than when only the outer peripheral contact portions 613, 613 of the first lower blade 61 contacted to the peripheral surface of the conductor crimping portion 30*a*, thereby increasing the resistance applied with left-right symmetry in the direction in which rotation of the conductor crimping portion 30*a* is suppressed.

As a result, the conductor crimping portion 30*a* is less likely to rotate, making it possible to deform, crimp, and connect the female type crimp terminal 10 and the insulated wire 200 in a desired crimping shape.

Figure 9:
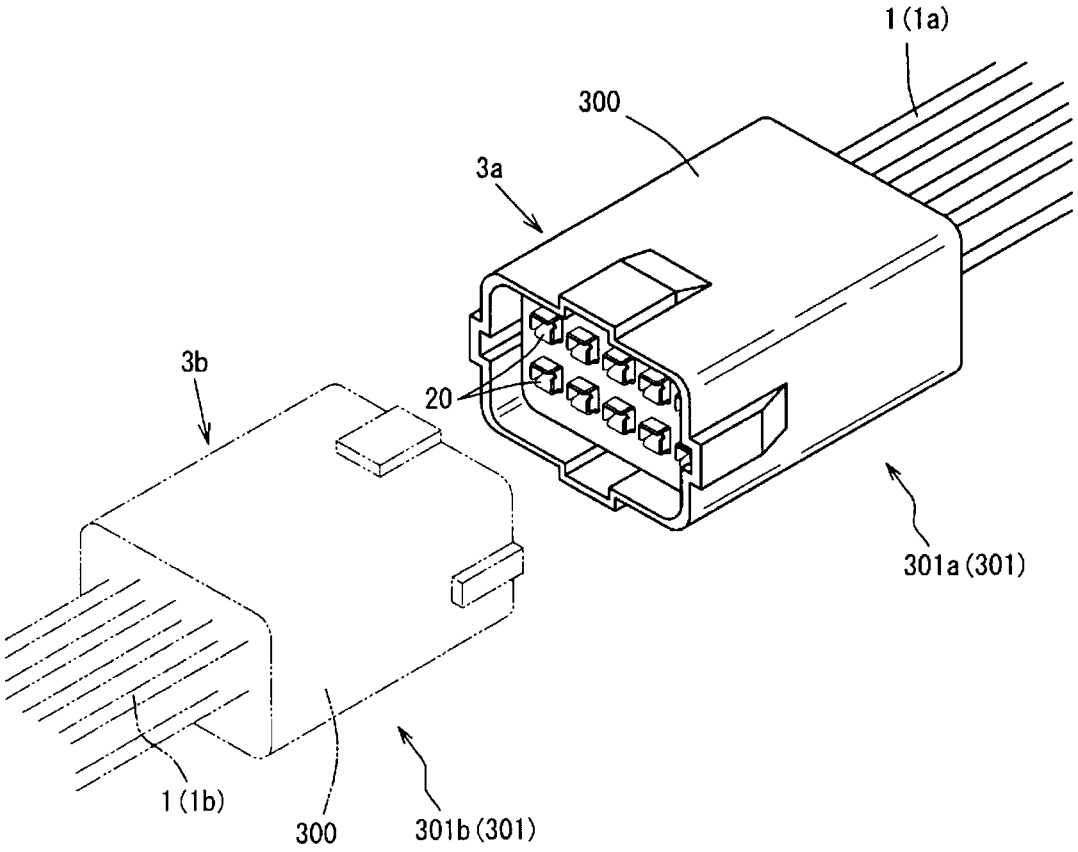
FIG. 9 is an explanatory perspective view of a connector.

Furthermore, the female type crimp terminal 10 to which the insulated wire 200 is connected can be reliably and smoothly inserted to the predetermined position inside the terminal insertion hole, such as a cavity in a connector housing 300 illustrated in FIG. 9, achieving stable insertion characteristics.

Furthermore, the conductor crimping portion 30*a* of the crimping portion 30 is deformed into a desired crimping shape, crimped, and connected to the conductor tip portion 201*a* of the aluminum core wire 201, making it less likely that a gap will occur between the conductor crimping portion 30*a* and the conductor tip portion 201, ensuring waterproof performance.

Therefore, after crimping, moisture is prevented from entering the interior of the conductor crimping portion 30*a*. Thus, galvanic corrosion, which would be caused by moisture attaching to a contacting portion where the female type crimp terminal 10 formed from copper or a copper alloy that is a noble metal and the aluminum core wire 201 formed from aluminum or an aluminum alloy that is a base metal are connected to each other, is prevented.

Working Example 2

While the aforementioned working example 1 has described an example in which the first crimping device 60A crimps the conductor crimping portion 30*a* of the crimping portion 30 to the substantially U-shaped crimping portion 44A that includes the concave portion 45, the conductor crimping portion 30*a* may be crimped to a substantially elliptic-shaped crimping portion 44B that does not include the concave portion 45 using a second crimping device 60B.

The aforementioned substantially elliptic-shaped crimping portion 44B is formed by deforming the conductor crimping portion 30*a* of the crimping portion 30 by the crimping device 60B.

Figure 6A:
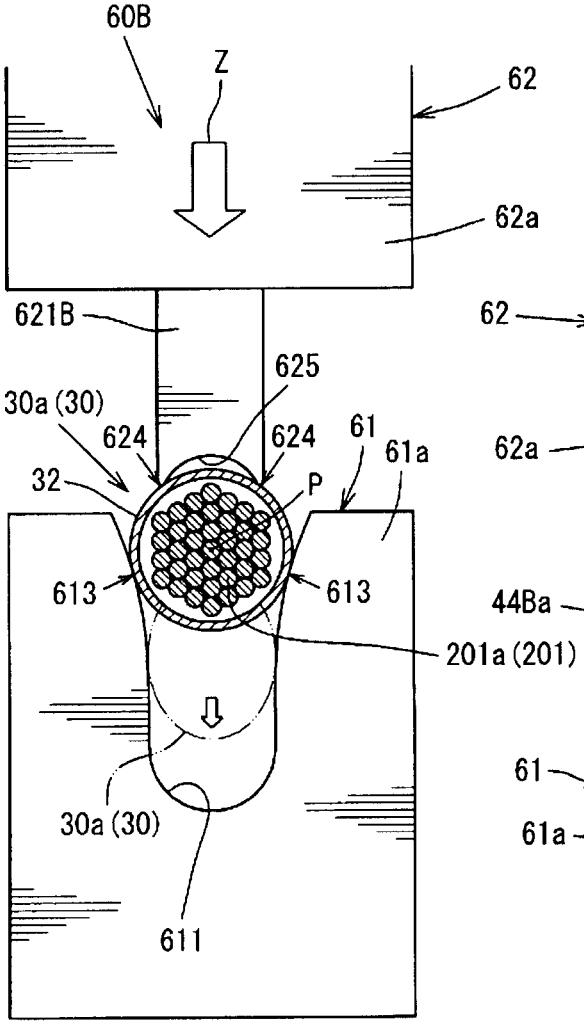
FIGS. 6A to 6C are explanatory views of a method for crimping a crimping portion by a second crimping device.
Figure 6B:
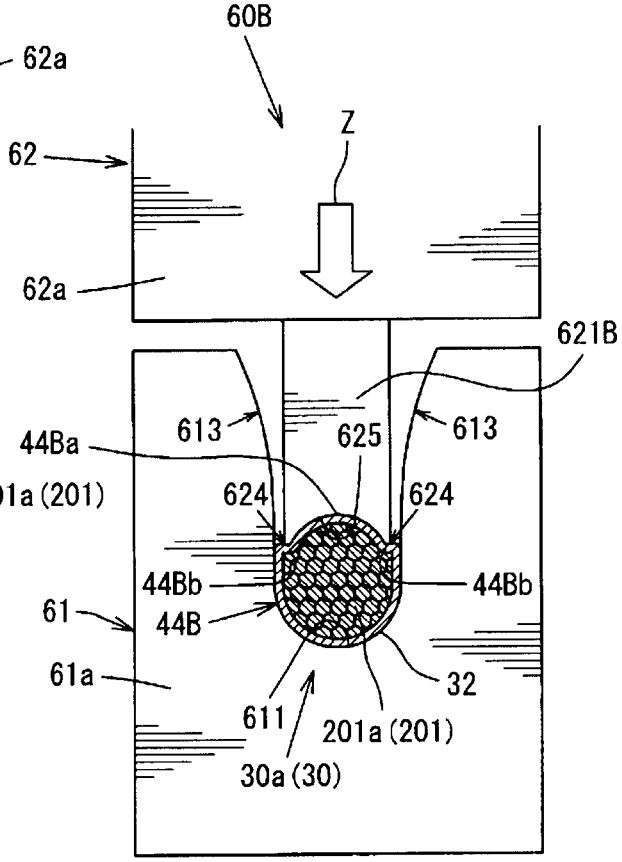
Figure 6C:
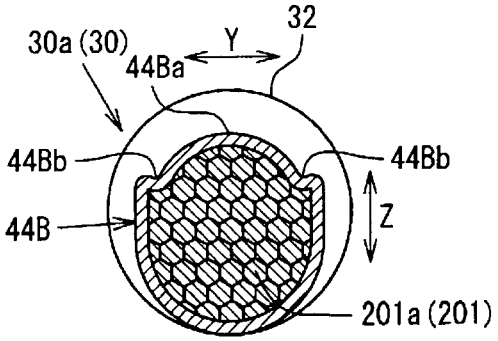

The substantially elliptic-shaped crimping portion 44B has a convex, arced cross section on the lower surface side that includes the crimping bottom surface 31 of the crimping portion 30, and includes a convex protruding portion 44Ba in which a center portion in the width direction Y on an upper surface side protrudes upward into an arced cross section, and recessed portions 44Bb in which both side portions in the width direction Y of the convex protruding portion 44Ba are recessed into a concave shape toward the upper surface side (refer to FIG. 6C).

FIGS. 6A to 6C are explanatory views of the method for crimping the crimping portion 30 by the crimping device 60B. Specifically, FIG. 6A is a schematic view during the initial period of the crimping operation by which the crimping portion 30 is deformed by the crimping device 60B, FIG. 6B is a schematic view of the crimping portion 30 deformed, crimped, and connected by the crimping device 60B, and FIG. 6C is an enlarged view of the perpendicular cross section of the substantially elliptic-shaped crimping portion 44B as viewed from the frontward side X1 in the longitudinal direction X.

It should be noted that the configuration of the rear-side receiving portion 61*b* of the lower blade 61 and the rear-side pressurizing portion 62*b* of the upper blade 62 in the crimping device 60B have been described in detail in the explanation of the configuration of the above-described crimping device 60A, and thus details thereof will be omitted.

The receiving groove 611 of the front-side receiving portion 61*a* of the lower blade 61 is formed to have a groove width and groove depth that allow perpendicular insertion of a protruding portion 621B suspended from a lower end portion of the center portion in the width direction Y of the front-side pressurizing portion 62*a* of the upper blade 62.

The outer peripheral contact portion 613 is formed on each of upper end side inner wall portions on both side portions in the width direction Y of the receiving groove 611. These outer peripheral contact portions 613 are point-contacted to the lower side outer periphery of the conductor crimping portion 30*a* in the perpendicular cross section so as to be left-right symmetrical with respect to the reference plane.

The protruding portion 621B of the front-side pressurizing portion 62*a* of the upper blade 62 is formed to have a width that is narrower than the aforementioned groove width of the receiving groove 611.

An outer peripheral contact portion 624 is formed on each of the lower end portions of both side portions in the width direction Y of the protruding portion 621B. These outer peripheral contact portions 624 are point-contacted to the upper side outer periphery of the conductor crimping portion 30*a* in the perpendicular cross section so as to be left-right symmetrical with respect to the reference plane.

The outer peripheral contact portion 624 has a protruding shape that protrudes downward as viewed from the frontward side X1 in the longitudinal direction X, and is point-contacted to the upper side outer periphery of the conductor crimping portion 30*a* in the perpendicular cross section so as to be left-right symmetrical (refer to FIG. 6A).

Further, the outer peripheral contact portion 624 is disposed at a spacing so as to be point-contacted to the upper side outer periphery of the conductor crimping portion 30*a* in the perpendicular cross section in a left-right symmetrical manner, and disposed so that the contacting locations of the lower side outer periphery of the conductor crimping portion 30*a* and the outer peripheral contact portions 613 of both side portions in the width direction Y are left-right symmetrical with respect to the reference plane.

The outer peripheral contact portions 624, 624 of the upper blade 62 are disposed inward of the area between the outer peripheral contact portions 613, 613 at a spacing narrower than the spacing between the outer peripheral contact portion 613, 613 of the lower blade 61.

Further, a convex forming portion 625 having a curvature radius smaller than that of an upper side outer periphery of the conductor crimping portion 30*a* before crimping and a smooth curved surface is formed in a downward concave state on the lower end portion of the center portion in the width direction Y of the protruding portion 621B.

The aforementioned outer peripheral contact portion 624 and convex forming portion 625 are formed to have a length corresponding to the longitudinal direction X of the conductor crimping portion 30*a* to be crimped.

That is, when the conductor crimping portion 30*a* is crimped, the outer peripheral contact portion 624 is point-contacted and line-contacted in the longitudinal direction X to the upper side outer periphery of both side portions in the width direction Y of the conductor crimping portion 30*a* in the perpendicular cross section so as to be left-right symmetrical.

The convex forming portion 625 is line-contacted and surface-contacted in the longitudinal direction X to the upper side outer periphery of the center portion in the width direction Y of the conductor crimping portion 30*a* in the perpendicular cross section so as to be left-right symmetrical.

When the female type crimp terminal 10 and the insulated wire 200 are crimped and connected using the crimping device 60B configured as described above, the conductor crimping portion 30*a* of the crimping portion 30 is retained by the lower blade 61 and the upper blade 62.

At this time, the outer peripheral contact portions 613, 613 of the front-side receiving portion 61*a* of the lower blade 61, serving as first contacted sections, are point-contacted in two locations to the lower side outer periphery of the conductor crimping portion 30*a* in the perpendicular cross section so as to be left-right symmetrical with respect to the reference plane, and each outer peripheral contact portion 613 is line-contacted in the longitudinal direction X along the lower side outer periphery of the conductor crimping portion 30*a* (refer to FIG. 6A).

Subsequently, the upper blade 62 is moved in the crimping direction Z, and the outer peripheral contact portions 624, 624 of the front-side pressurizing portion 62*a* of the upper blade 62 are point-contacted in two locations to the upper side outer periphery of the conductor crimping portion 30*a* in the perpendicular cross section so as to be left-right symmetrical with respect to the reference plane, and each outer peripheral contact portion 624 is line-contacted in the longitudinal direction X along the upper side outer periphery of the conductor crimping portion 30*a* (refer to FIG. 6A).

Next, during the initial period of the crimping operation by which the lower blade 61 and the upper blade are moved in the crimping direction Z to deform the conductor crimping portion 30*a*, resistance resulting from the point contacts and the line contact in the longitudinal direction X of the outer peripheral contact portions 613, 613 of the lower blade 61, resistance resulting from the point contacts and the line contact in the longitudinal direction X of the outer peripheral contact portions 624, 624 of the upper blade 62, and resistance resulting from the outer peripheral contact portions 613, 624 penetrating the vertical outer periphery of the conductor crimping portion 30*a* are applied to the outer periphery of the conductor crimping portion 30*a* with left-right symmetry.

The aforementioned resistances are applied with left-right symmetry in a direction in which the rotation about the center portion P in the radial direction of the conductor crimping portion 30*a* in the perpendicular cross section is suppressed, making it possible to prevent displacement of the orientation and position of the conductor crimping portion 30*a*.

That is, the outer peripheral contact portions 613, 613 of the lower blade 61 and the outer peripheral contact portions 624, 624 of the upper blade 62 are point-contacted in four locations and line-contacted in the longitudinal direction X to the peripheral surface of the conductor crimping portion 30*a* in the perpendicular cross section so as to be left-right symmetrical.

Compared to the crimping device 60A in which the outer peripheral contact portions 613, 613 of the lower blade 61 and the outer peripheral contact portion 623 of the upper blade 62 are point-contacted in three locations in the working example 1 (refer to FIGS. 5A to 5C), the crimping device 60B has more locations that are point-contacted and line-contacted to the peripheral surface of the conductor crimping portion 30*a* so as to be left-right symmetrical, and greater resistance applied in the direction in which rotation of the conductor crimping portion 30*a* is suppressed, making the conductor crimping portion 30*a* more less likely to rotate.

With this arrangement, at the start of the operation by which the conductor crimping portion 30*a* is deformed, the conductor crimping portion 30*a* is contracted in the width direction Y while pressed inside the receiving groove 611 of the lower blade 61, and thus deformed into a substantially elliptic shape without the occurrence of rotation, twisting, or the like in the conductor crimping portion 30*a* (refer to the long dashed double-short dashed line in FIG. 6A).

Furthermore, the conductor crimping portion 30*a* is deeply pressed to a position that reaches the bottom surface portion of the receiving groove 611, making it possible to deform the conductor crimping portion 30*a* into a crimping shape such as the substantially elliptic-shaped crimping portion 44B (refer to FIG. 6B).

Accordingly, the conductor crimping portion 30*a* of the crimping portion 30 is accurately deformed into a desired crimping shape that forms the substantially elliptic-shaped crimping portion 44B, making it possible to reliably crimp and connect the conductor crimping portion 30*a* to the conductor tip portion 201*a* of the aluminum core wire 201 (refer to FIG. 6C).

As a result, during the initial period of the crimping operation by which the conductor crimping portion 30*a* is deformed, it is possible to more reliably prevent the conductor crimping portion 30*a* from rotating about the center portion P in the radial direction and becoming displaced in orientation and position. The conductor crimping portion 30*a* is therefore less likely to rotate, making it possible to more reliably crimp and connect the female type crimp terminal 10 and the insulated wire 200.

Working Example 3

Figure 7A:
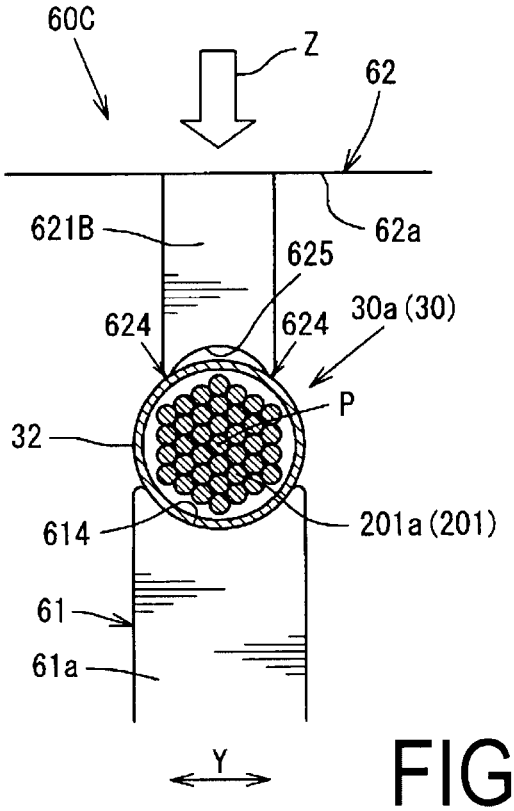
FIGS. 7A to 7C are explanatory views of a method for crimping a crimping portion by a third crimping device.
Figure 7B:
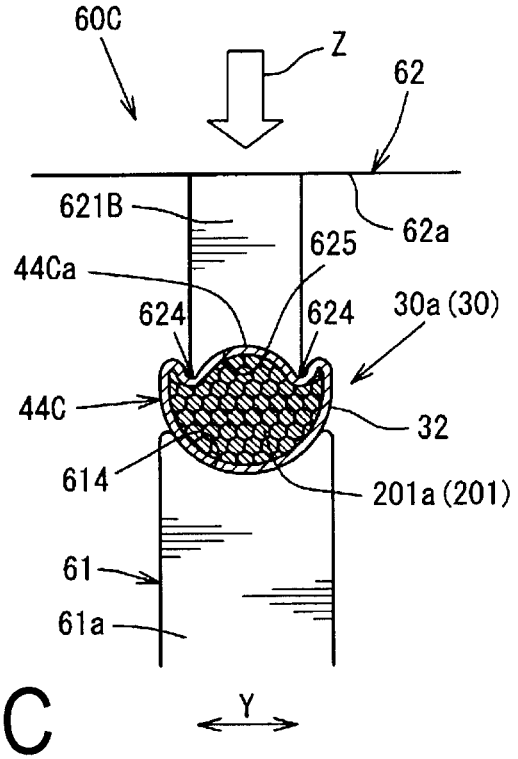
Figure 7C:
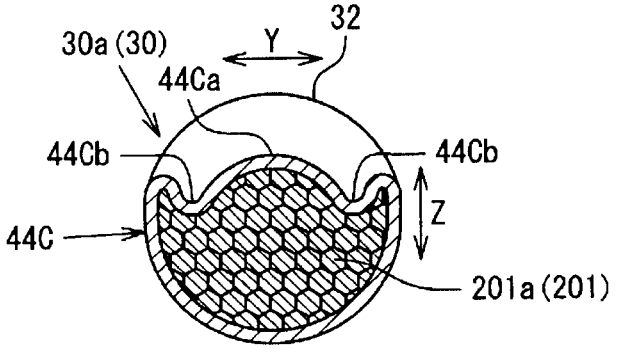

Further, a crimping device 60C illustrated in FIGS. 7A to 7C may be used for crimping the conductor crimping portion 30*a* of the crimping portion 30 in place of the aforementioned crimping devices 60A, 60B so that the conductor crimping portion 30*a* forms a substantially semicircle crimping portion 44C that includes a pair of recessed portions 44Cb.

The aforementioned substantially semicircle crimping portion 44C is formed by deforming the conductor crimping portion 30*a* of the crimping portion 30 by the crimping device 60C.

The substantially semicircle crimping portion 44C has a convex, arced cross section on the lower surface side that includes the crimping bottom surface 31 of the crimping portion 30, and includes a convex protruding portion 44Ca in which the center portion in the width direction Y on the upper surface side protrudes upward into an arced cross section, and the recessed portions 44Cb in which both side portions in the width direction Y of the convex protruding portion 44Ca are recessed into a concave shape toward the upper surface side (refer to FIG. 7C).

FIGS. 7A to 7C are explanatory views of the method for crimping the crimping portion 30 by the crimping device 60C. Specifically, FIG. 7A is a schematic view during the initial period of the crimping operation by which the crimping portion 30 is deformed by the crimping device 60C, FIG. 7B is a schematic view of the crimping portion 30 deformed, crimped, and connected by the crimping device 60C, and FIG. 7C is an enlarged view of the perpendicular cross section of the substantially semicircle crimping portion 44C as viewed from the frontward side X1 in the longitudinal direction X.

It should be noted that the configuration of the rear-side receiving portion 61*b* of the lower blade 61 and the rear-side pressurizing portion 62*b* of the upper blade 62 in the crimping device 60C have been described in detail in the explanation of the configuration of the above-described crimping device 60A, and thus details thereof will be omitted.

An outer peripheral contact portion 614 is formed on the upper end portion of the front-side receiving portion 61*a* of the lower blade 61. This outer peripheral contact portion 614 is line-contacted to the lower side outer periphery of the conductor crimping portion 30*a* in the perpendicular cross section so as to be left-right symmetrical with respect to the reference plane.

The contacting location where the outer peripheral contact portion 614 contacts the lower side outer periphery of the conductor crimping portion 30*a* is formed on a smooth curved surface so as to be symmetrical with respect to the reference plane. Specifically, the contacting location is formed on an arced surface having a curvature radius corresponding to the lower side outer periphery of the conductor crimping portion 30*a*.

Further, the outer peripheral contact portion 614 is formed to have a length corresponding to the longitudinal direction X of the conductor crimping portion 30*a* to be crimped.

That is, when the conductor crimping portion 30*a* is crimped, the outer peripheral contact portion 614 is line-contacted and surface contacted in the longitudinal direction X to the lower side outer periphery of the center portion in the width direction Y of the conductor crimping portion 30*a* in the perpendicular cross section (refer to FIG. 7A).

Meanwhile, the configuration of the protruding portion 621B that is suspended from the front-side pressurizing portion 62*a* of the upper blade 62, and the configuration of the outer peripheral contact portion 624 that is formed on both end portions in the width direction Y of the protruding portion 621B have been described in detail in the explanation of the configuration of the above-described crimping device 60B, and thus details thereof will be omitted.

When the female type crimp terminal 10 and the insulated wire 200 are crimped and connected using the crimping device 60C configured as described above, the conductor crimping portion 30*a* of the crimping portion 30 is retained by the lower blade 61 and the upper blade 62.

At this time, the outer peripheral contact portion 614 of the front-side receiving portion 61*a* of the lower blade 61, serving as a first contacted section, is line-contacted to the lower side outer periphery of the conductor crimping portion 30*a* in the perpendicular cross section so as to be left-right symmetrical with respect to the reference plane, and surface-contacted in the longitudinal direction X along the lower side outer periphery of the conductor crimping portion 30*a* (refer to FIG. 7A).

Subsequently, the upper blade 62 is moved in the crimping direction Z, and the outer peripheral contact portions 624, 624 of the front-side pressurizing portion 62*a* of the upper blade 62 are point-contacted in two locations to the upper side outer periphery of the conductor crimping portion 30*a* in the perpendicular cross section so as to be left-right symmetrical with respect to the reference plane, and each outer peripheral contact portion 624 is line-contacted in the longitudinal direction X along the upper side outer periphery of the conductor crimping portion 30*a* (refer to FIG. 7A).

Next, during the initial period of the crimping operation by which the lower blade 61 and the upper blade are moved in the crimping direction Z to deform the conductor crimping portion 30*a*, resistance resulting from the line contact and the surface contact in the longitudinal direction X of the outer peripheral contact portion 614 of the lower blade 61, resistance resulting from the point contacts and the line contacts in the longitudinal direction X of the outer peripheral contact portions 624, 624 of the upper blade 62, and resistance resulting from the outer peripheral contact portions 624, 624 penetrating the upper side outer periphery of the conductor crimping portion 30*a* are applied to the outer periphery of the conductor crimping portion 30*a* with left-right symmetry.

The aforementioned resistances are applied with left-right symmetry in a direction in which a rotation about the center portion P in the radial direction of the conductor crimping portion 30*a* in the perpendicular cross section is suppressed, making it possible to prevent displacement of the orientation and position of the conductor crimping portion 30*a*.

That is, the outer peripheral contact portion 614 of the lower blade 61 is line-contacted and surface-contacted in the longitudinal direction X to the lower side outer periphery of the conductor crimping portion 30*a* in the perpendicular cross section so as to be left-right symmetrical (refer to FIG. 7A).

Compared to the crimping device 60B in which the outer peripheral contact portions 613, 613 of the lower blade 61 and the outer peripheral contact portions 624, 624 of the upper blade 62 are point-contacted in the working example 2 (refer to FIG. 6A to 6C), the crimping device 60C has a larger contact surface area of the outer peripheral contact portion 614 that is contacted to the lower side outer periphery of the conductor crimping portion 30*a* so as to be left-right symmetrical and even greater resistance applied in the direction in which rotation of the conductor crimping portion 30*a* is suppressed, making the conductor crimping portion 30*a* even less likely to rotate.

With this arrangement, at the start of the operation by which the conductor crimping portion 30*a* is deformed, it is possible to deform the conductor crimping portion 30*a* into a desired crimping shape such as the substantially semicircle crimping portion 44C without the occurrence of rotation, twisting, or the like in the conductor crimping portion 30*a* (refer to FIG. 7B).

Accordingly, the conductor crimping portion 30*a* of the crimping portion 30 is accurately deformed into a desired crimping shape that forms the substantially semicircle crimping portion 44C, making it possible to more accurately and reliably crimp and connect the conductor crimping portion 30*a* to the conductor tip portion 201*a* of the aluminum core wire 201 (refer to FIG. 7C).

As a result, during the initial period of the crimping operation by which the conductor crimping portion 30*a* is deformed, it is possible to more actively prevent the conductor crimping portion 30*a* from rotating about the center portion P in the radial direction and becoming displaced in orientation and position. The conductor crimping portion 30*a* is therefore even less likely to rotate, making it possible to crimp and connect the female type crimp terminal 10 and the insulated wire 200 with even higher accuracy.

Further, the outer peripheral contact portion 614 of the lower blade 61 having a curvature radius that corresponds to the lower side outer periphery is surface-contacted to the lower side outer periphery of the conductor crimping portion 30*a*, thereby further increasing the stability of the conductor crimping portion 30*a* during crimping, making it possible to more reliably prevent the conductor crimping portion 30*a* from becoming displaced in orientation and position.

Working Example 4

Figure 8A:
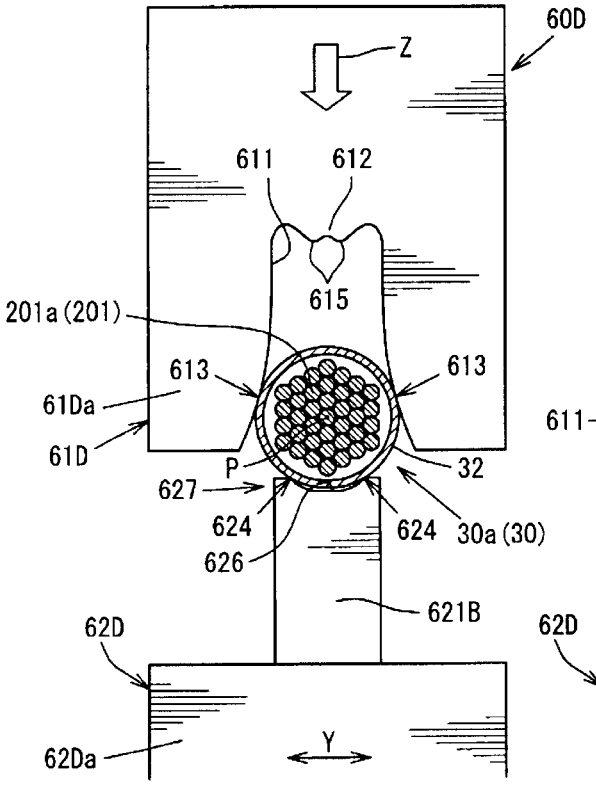
FIGS. 8A to 8C are explanatory views of a method for crimping a crimping portion by a fourth crimping device.
Figure 8B:
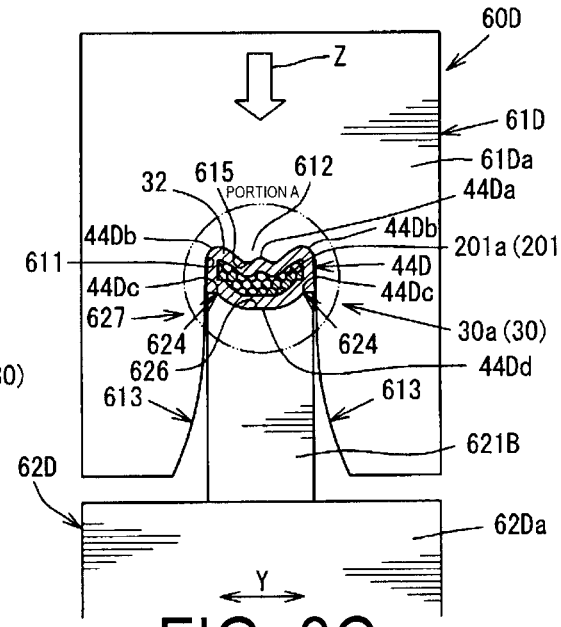
Figure 8C:
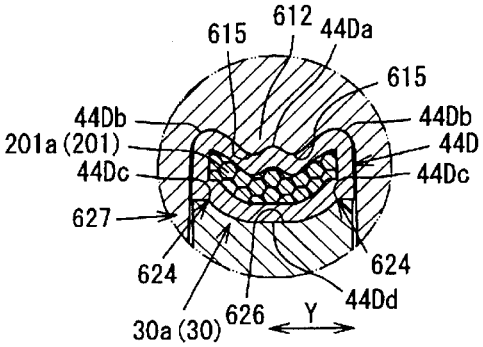

While the aforementioned working example 2 has described the second crimping device 60B that forms the conductor crimping portion 30*a* of the crimping portion 30 into substantially elliptic-shaped crimping portion 44B, the conductor crimping portion 30*a* may be crimped using a fourth crimping device 60D illustrated in FIGS. 8A to 8C so as to become a substantially M-shaped crimping portion 44D that includes a protruding portion 44Db on the upper surface side and a flat portion 44Dd on the lower surface side.

The aforementioned substantially M-shaped crimping portion 44D is formed by deforming the conductor crimping portion 30*a* of the crimping portion 30 by the crimping device 60D.

The substantially M-shaped crimping portion 44D has a convex, arced cross section on the lower surface side that includes the crimping bottom surface 31 of the crimping portion 30, and includes a protruding portion 44Da in which the center portion in the width direction Y on the upper surface side protrudes upward into a convex shape, the protruding portions 44Db in which both end portions in the width direction Y on the upper surface side protrude upward into convex shapes, recessed portions 44Dc in which both end portions in the width direction Y on the lower surface side are recessed toward the inside in the radial direction, and a flat portion 44Dd in which the center portion in the width direction Y on the lower surface side is perpendicular to the crimping direction Z and flat (refer to FIG. 8C).

The fourth crimping device 60D that crimps the crimping portion 30 so that the crimping portion 30 forms the substantially M-shaped crimping portion 44D such as described above includes an upper blade 61D that pressurizes the conductor crimping portion 30*a* of the crimping portion 30 from above, and a lower blade 62D that pressurizes the conductor crimping portion 30*a* from below.

It should be noted that the configurations of the upper blade 61D and the lower blade 62D are those of the lower blade 61 and the upper blade 62 of the crimping device 60B turned upside down, respectively, and sections with the same configuration as the crimping device 60B are denoted using the same reference numbers, and thus detailed descriptions thereof will be omitted.

FIGS. 8A to 8C are explanatory views of the method for crimping the crimping portion 30 by the crimping device 60D. Specifically, FIG. 8A is a schematic view during the initial period of the crimping operation by which the crimping portion 30 is deformed by the crimping device 60D, FIG. 8B is a schematic view of the crimping portion 30 deformed, crimped, and connected by the crimping device 60D, and FIG. 8C is an enlarged cross-sectional view of a portion a of the substantially M-shaped crimping portion 44D as viewed from the frontward side X1 in the longitudinal direction X.

The receiving groove 611 of a front-side pressurizing portion 61Da of the upper blade 61D is formed to have a groove width and a groove depth that allow perpendicular insertion of the protruding portion 621B of a front-side receiving portion 62Da of the lower blade 62D.

The outer peripheral contact portion 613 is formed on each of the lower end side inner wall portions of both side portions in the width direction Y of the receiving groove 611. These outer peripheral contact portions 613 are point-contacted to the upper side outer periphery of the conductor crimping portion 30*a* so as to be left-right symmetrical with respect to the reference plane.

A two-mountain shaped protrusion forming portion 612 for forming the aforementioned protruding portion 44Da on the upper side outer periphery of the center portion in the width direction Y of the conductor crimping portion 30*a* in the perpendicular cross section protrudes downward in a convex state from the upper end side inner periphery of the center portion in the width direction Y of the receiving groove 611.

An outer peripheral contact portion 615 is formed in two locations on the lower end portion of the protrusion forming portion 612 at a predetermined spacing in the width direction Y so as to become a two mountain shape. The outer peripheral contact portions 615 are point-contacted to the upper side outer periphery of the conductor crimping portion 30*a* so as to be left-right symmetrical with respect to the reference plane.

The protruding portion 621B of the front-side receiving portion 62Da of the lower blade 62D is formed narrower than the groove width of the aforementioned receiving groove 611, and an angular-shaped outer peripheral contact portion 624 is formed on each of both end portions in the width direction Y of the protruding portion 621B. These outer peripheral contact portions 624 are point-contacted to the lower side outer periphery of the conductor crimping portion 30*a* so as to be left-right symmetrical with respect to the reference plane.

A flat forming portion 626 for forming the aforementioned flat portion 44Dd on the lower side outer periphery of the center portion in the width direction Y of the conductor crimping portion 30*a* in the perpendicular cross section is formed on the upper end portion of the center portion in the width direction Y of the protruding portion 621B.

Furthermore, a dish-shaped placing portion 627 that allows placement of the conductor crimping portion 30*a* includes the outer peripheral contact portions 624 and the flat forming portion 626.

When the conductor crimping portion 30*a* of the crimping portion 30 and the conductor tip portion 201*a* of the aluminum core wire 201 are crimped and connected using the crimping device 60D configured as described above, the conductor crimping portion 30*a* of the crimping portion 30 is horizontally supplied from a right side or left side in the figure to the placing portion 627 of the protruding portion 621B of the lower blade 62D, and placed parallel with the longitudinal direction X.

At the time of placement, the outer peripheral contact portions 624, 624 of the protruding portion 621B of the lower blade 62D, serving as first contacted sections, are point-contacted in two locations to the lower side outer periphery of the conductor crimping portion 30*a* so as to be left-right symmetrical, and line-contacted in the longitudinal direction X along the lower side outer periphery (refer to FIG. 8A).

The upper blade 61D is then lowered to a height position where the outer peripheral contact portions 613, 613 of the receiving groove 611 are contacted to the conductor crimping portion 30*a* placed on the protruding portion 621B of the lower blade 62D.

The outer peripheral contact portions 613, 613 of the receiving groove 611 of the upper blade 61D are point-contacted in two locations to the upper side outer periphery of the conductor crimping portion 30*a* so as to be left-right symmetrical, and line-contacted in the longitudinal direction X along the upper side outer periphery (refer to FIG. 8A).

Next, during the initial period of the crimping operation by which the upper blade 61D and the lower blade 62D are moved in the crimping direction Z to deform the conductor crimping portion 30*a*, resistance resulting from the point contacts and the line contacts in the longitudinal direction X of the outer peripheral contact portions 613, 613 of the upper blade 61D, resistance resulting from the point contacts and the line contacts in the longitudinal direction X of the outer peripheral contact portions 624, 624 of the lower blade 62D, and resistance resulting from the outer peripheral contact portions 624, 624 penetrating the lower side outer periphery of the conductor crimping portion 30*a* are applied to the outer periphery of the conductor crimping portion 30*a* with left-right symmetry.

The aforementioned resistances are applied with left-right symmetry in a direction in which a rotation about the center portion P in the radial direction of the conductor crimping portion 30*a* in the perpendicular cross section is suppressed, making it possible to prevent displacement of the orientation and position of the conductor crimping portion 30*a*.

After the conductor crimping portion 30*a* of the aforementioned crimping portion 30 is retained by the upper blade 61D and the lower blade 62D, the upper blade 61D and the lower blade 62D are moved in the crimping direction Z, and the conductor crimping portion 30*a* is contracted in the width direction Y while pressed inside the receiving groove 611 of the upper blade 61D, deforming into a substantially elliptic shape (refer to the long and long dashed double-short dashed line in FIG. 8A).

Furthermore, immediately before the conductor crimping portion 30*a* is pressed to the upper end portion of the receiving groove 611, the outer peripheral contact portion 624, 624 of the protruding portion 621B are point-contacted in two locations and line-contacted in the longitudinal direction X to the upper side outer periphery of the conductor crimping portion 30*a* so as to be left-right symmetrical.

When the conductor crimping portion 30*a* is more deeply pressed to the position that reaches the upper end portion of the receiving groove 611, the outer peripheral contact portions 624, 624 of the protruding portion 621B and the outer peripheral contact portions 615, 615 of the receiving groove 611 are pressed while contacted to the outer periphery of the conductor crimping portion 30*a* so as to be left-right symmetrical, making it possible to more reliably prevent the occurrence of rotation and twisting and also to prevent the collapse of a side surface of the conductor crimping portion 30*a* toward the inside in the width direction Y.

The conductor crimping portion 30*a* is pressed to a position that reaches an upper end side groove bottom surface of the receiving groove 611 while retained to form it into a desired crimping shape, making it possible to deform, crimp, and connect the conductor crimping portion 30*a* in a desired crimping shape (refer to FIG. 8B).

With this arrangement, at the start of the crimping operation by which the conductor crimping portion 30*a* is deformed, and immediately before completion of the crimping operation, it is possible to deform the conductor crimping portion 30*a* into a desired crimping shape without the occurrence of rotation, twisting, or the like in the conductor crimping portion 30*a* (refer to FIG. 8B).

Accordingly, the conductor crimping portion 30*a* of the crimping portion 30 is accurately deformed into a desired crimping shape such as the substantially M-shaped crimping portion 44D, and thus more accurately and reliably crimped and connected to the conductor tip portion 201*a* of the aluminum core wire 201 (refer to the enlarged view of the a portion in FIG. 8C).

As a result, during the initial period of the crimping operation by which the conductor crimping portion 30*a* is deformed, and immediately before completion of the crimping operation, it is possible to more actively prevent the conductor crimping portion 30*a* from rotating about the center portion P in the radial direction and becoming displaced in orientation and position, and to crimp and connect the female type crimp terminal 10 and the insulated wire 200 with higher accuracy.

Moreover, the upper side outer periphery of the conductor crimping portion 30*a* is pressed from the upper portion by the outer peripheral contact portions 615, 615 of the receiving groove 611 and crimped and connected to the conductor tip portion 201*a* of the aluminum core wire 201, which is effective in reducing the compression rate of the aluminum core wire 201 by the conductor crimping portion 30*a* and makes it possible to more reliably crimp and connect the conductor crimping portion 30*a* to the conductor tip portion 201*a* of the aluminum core wire 201.

With this arrangement, it is possible to prevent a so-called inward collapse where a side surface of the conductor crimping portion 30*a* collapses toward the inside in the width direction Y, and the occurrence of variance in the crimping shape is less likely during mass production of the crimping connection structure 1, making it possible to crimp and connect in a desired crimping shape.

Furthermore, during crimping, the protruding portions 44Db, 44Db of the substantially M-shaped crimping portion 44D are regulated to heights that are equivalent on the left and right by the protrusion forming portion 612 of the receiving groove 611 of the upper blade 61D, making it possible to deform the protruding portions 44Db, 44Db to a desired height and shape without variance. With this arrangement, it is possible to deform, crimp, and connect the conductor crimping portion 30*a* in a desired crimping shape with higher accuracy.

Furthermore, after crimping, when predetermined items such as the crimping height and crimping width of the substantially M-shaped crimping portion 44D are measured using a measuring device, a lower portion gauge head of the measuring device is pressed to the flat portion 44Dd formed on the lower surface side of the substantially M-shaped crimping portion 44D, for example, making it possible to prevent displacement of the measurement position such as rotation or tilting of the female type crimp terminal 10 during measurement.

As a result, the orientation and position of the female type crimp terminal 10 are stable, making it possible to accurately measure predetermined items such as the crimp height and crimp width using the measuring device.

That is, by forming the flat portion 44Dd on the lower surface side of the substantially M-shaped crimping portion 44D, when the crimp height, crimp width, and the like are measured to determine whether crimping has been performed in the desired crimping shape, more accurate measurements can be taken with the flat portion 44Dd serving as a reference surface. Accordingly, it is possible to ensure stable crimping after crimping.

Furthermore, because the crimping device 60D of the working example 4 is configured to crimp using the upper blade 61D having an upside down U-shape (outside) and the lower blade 62D having a dish shape (inside), the female type crimp terminal 10 is supplied in order to a predetermined position for crimping so as to be placed in the placing portion 627 of the lower blade 62D, making it possible to easily supply and dispose the female type crimp terminal 10 without significantly moving the upper blade 61D vertically and thus to prevent the size of the crimping device 60D from increasing.

Specifically, when the conductor crimping portion 30*a* of the crimping portion 30 is pressed into a receiving groove having a substantially U-shaped cross section formed on the lower blade so as to be contracted and deformed, for example, the conductor crimping portion 30*a* must be inserted into the receiving groove from above and extracted from the receiving groove upward, resulting in difficulties in supplying the conductor crimping portion 30*a* to the receiving groove of the lower blade from the side.

Hence, because the placing portion 627 of the lower blade 62D is formed into a shallow dish shape in the crimping device 60D of the working example 4, it is possible to smoothly place the conductor crimping portion 30*a* of the crimping portion 30 onto the placing portion 627 of the lower blade 62D from the side. With this arrangement, it is possible to perform the crimping operation without significantly moving the upper blade 61D vertically.

In particular, when a chain terminal in which a multiplicity of terminal metal fittings (not illustrated) are arrayed in parallel in succession on one side edge of a carrier, the crimping portion of the chain terminal can be placed on the placing portion 627 of the lower blade 62D from the side, making it possible to continuously perform an operation by which the conductor crimping portion 30*a* of the crimping portion 30 is crimped and connected to the conductor tip portion 201*a* of the aluminum core wire 201.

That is, because the stroke of the upper blade 61D moving up and down is shorter, the operation time required for the vertical movement of the upper blade 61D can be significantly shortened, making it possible to further increase the crimping speed by the upper blade 61D and the lower blade 62D and further improve productivity.

It should be noted that, even with the crimping device 60C of the working example 3, the female type crimp terminal 10 is supplied in order to a predetermined position for crimping so as to be placed in the dish-shaped (inside) lower blade 61 in the same way as described above, making it possible to easily supply and dispose the female type crimp terminal 10 in a predetermined position without significant vertical movement and thus to prevent the size of the crimping device 60C from increasing.

Next, an example in which a crimping connection structure 1*a* that uses the aforementioned female type crimp terminal 10 and a crimping connection structure 1*b* that uses a male type crimp terminal (not illustrated) are mounted to a pair of respective connector housings 300 will be described using the explanatory perspective view of the connector in FIG. 9.

It should be noted that the crimping connection structure 1*a* is a connection structure that uses the female type crimp terminal 10, and the crimping connection structure 1*b* is a connection structure that uses the male type crimp terminal.

The aforementioned crimping connection structures 1 (1*a*, 1*b*) are mounted to the respective connector housings 300, making it possible to configure a female type connector 3*a* and a male type connector 3*b* having reliable conductivity.

It should be noted that while the following describes an example in which both the female type connector 3*a* and the male type connector 3*b* are connectors of wire harnesses 301 (301*a*, 301*b*), one may be a connector of a wire harness and the other may be a connector of an auxiliary device such as a substrate or part.

Specifically, as illustrated in FIG. 9, a plurality of the crimping connection structures 1*a* that each include the female type crimp terminal 10 are collected into a bundle and mounted to the female type connector housing 300 so as to constitute the wire harness 301*a* that includes the female type connector 3*a*.

Further, the crimping connection structures 1*b* that include the male type crimp terminal are mounted to the male type connector housing 300 so as to constitute the wire harness 301*b* that includes the male type connector 3*b*.

The wire harness 301*a* and the wire harness 301*b* can be connected by fitting together the female type connector 3*a* and the male type connector 3*b* that are configured as described above.

Because the crimping connection structures 1 are mounted to the connector housings 300, a connection of the wire harnesses 301 having reliable conductivity can be achieved.

Next, another method for crimping the conductor crimping portion 30*a* of the crimping portion 30 in the working example 3 so as to become the substantially semicircle crimping portion 44C that includes a flat portion 44Cd on the lower surface side will be described.

Figure 10A:
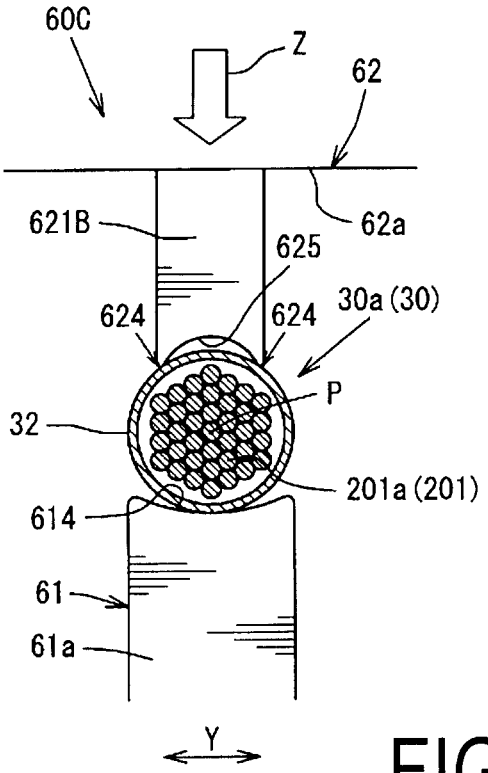
FIGS. 10A to 10C are explanatory views of another method for crimping by the third crimping device.
Figure 10B:
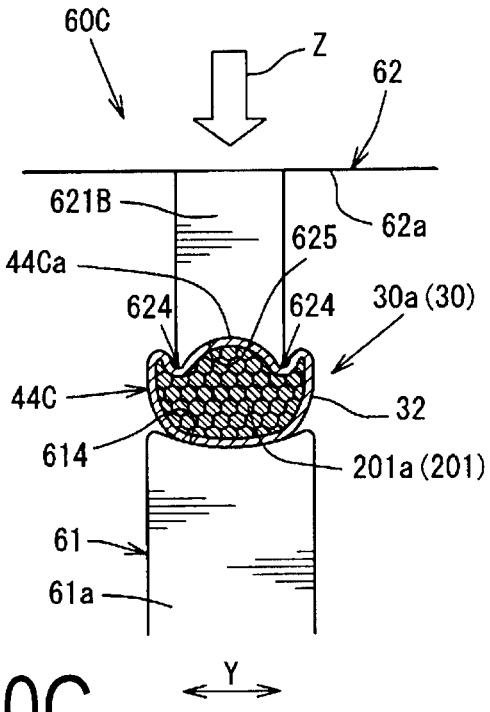
Figure 10C:
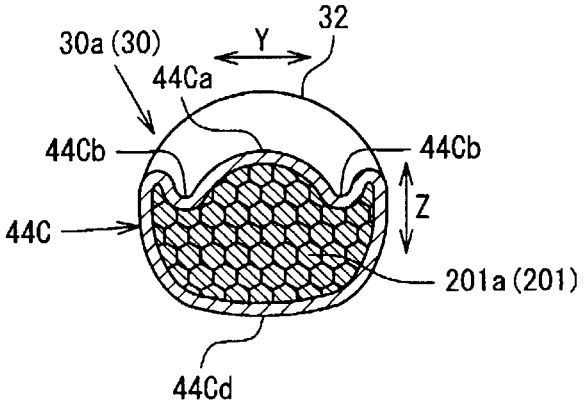

FIGS. 10A to 10C are explanatory views of another method for crimping the crimping portion 30 by the crimping device 60C. Specifically, FIG. 10A is a schematic view during the initial period of the crimping operation by which the crimping portion 30 is deformed by the crimping device 60C, FIG. 10B is a schematic view of the crimping portion 30 deformed, crimped, and connected by the crimping device 60C, and FIG. 10C is an enlarged view of the perpendicular cross section of the substantially semicircle crimping portion 44C as viewed from the frontward side X1 in the longitudinal direction X.

It should be noted that the configuration of the lower blade 61 and the upper blade 62 of the crimping device 60C that crimps the conductor crimping portion 30*a* of the crimping portion 30 has been described in the above-described working example 3, and thus details thereof will be omitted.

Specifically, the curvature radius of the outer peripheral contact portion 614 of the lower blade 61 is made greater than the curvature radius of the outer peripheral contact portion 614 described in the working example 3, and provided in a point-contactable manner to the lower side outer periphery of the conductor crimping portion 30*a* so as to be left-right symmetrical.

When the conductor crimping portion 30*a* of the crimping portion 30 is deformed by the lower blade 61 and the upper blade 62 of the crimping device 60C, the outer peripheral contact portion 614 of the lower blade 61 is point-contacted to the lower side outer periphery of the conductor crimping portion 30*a* and line-contacted in the longitudinal direction X along the lower side outer periphery of the conductor crimping portion 30*a* (refer to FIG. 10A).

The outer peripheral contact portions 624, 624 of the upper blade 62 are point-contacted in two locations to the upper side outer periphery of the conductor crimping portion 30*a* so as to be left-right symmetrical, and are each line-contacted in the longitudinal direction X along the upper side outer periphery of the conductor crimping portion 30*a* (refer to FIG. 10A).

With this arrangement, at the start of the operation by which the conductor crimping portion 30*a* is deformed, it is possible to deform the conductor crimping portion 30*a* into a desired crimping shape such as the substantially semicircle crimping portion 44C without the occurrence of rotation, twisting, or the like in the conductor crimping portion 30*a* (refer to FIGS. 10B and 100).

As a result, it is possible to reliably crimp and connect the conductor crimping portion 30*a* to the conductor tip portion 201*a* of the aluminum core wire 201.

Next, another example in which the conductor crimping portion 30*a* of the crimping portion 30 in the working example 4 is crimped so as to become the substantially M-shaped crimping portion 44D illustrated in FIG. 11 will be described.

Figure 11:
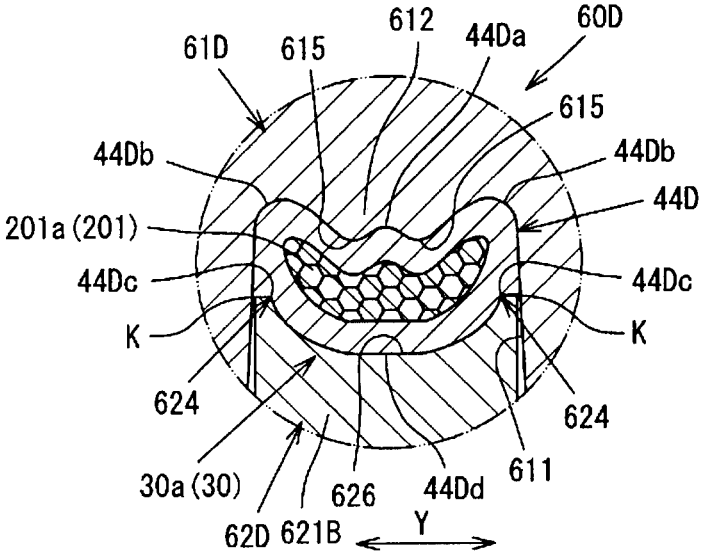
FIG. 11 is an enlarged cross-sectional view of a substantially M-shaped crimping portion formed in another crimping shape.

FIG. 11 is an enlarged cross-sectional view of the substantially M-shaped crimping portion 44D crimped into the crimping shape of the other example, specifically, an enlarged cross-sectional view of the substantially M-shaped crimping portion 44D as viewed from the frontward side X1 in the longitudinal direction X.

It should be noted that the configuration of the upper blade 61D and the lower blade 62D of the crimping device 60D that crimps the conductor crimping portion 30*a* of the crimping portion 30 has been described in the above-described working example 4, and thus details thereof will be omitted.

The aforementioned substantially M-shaped crimping portion 44D includes the protruding portions 44Da, 44Db, the recessed portion 44Dc, and the flat portion 44Dd in which the center portion in the width direction Y on the lower surface side is perpendicular to the crimping direction Z and flat (refer to FIG. 11), which are described in the working example 4.

Specifically, with the upper blade 61D and the lower blade 62D of the crimping device 60D in a crimping state in which the conductor crimping portion 30*a* of the crimping portion 30 is crimped so as to become the substantially M-shaped crimping portion 44D, a boundary portion K formed between an inner surface on an inside in the width direction Y of the receiving groove 611 of the upper blade 61D and both side portions in the width direction Y of the protruding portion 621B of the lower blade 62D is established in a higher position than that of the flat portion 44Dd of the substantially M-shaped crimping portion 44D (refer to FIG. 11).

When the conductor crimping portion 30*a* of the crimping portion 30 is deformed and crimped so as to become the substantially M-shaped crimping portion 44D by the upper blade 61D and the lower blade 62D of the crimping device 60C, the deformation rate of the recessed portion 44Dc of the substantially M-shaped crimping portion 44D is high, making both end portions in the width direction Y of the substantially M-shaped crimping portion 44D highly susceptible to burrs (not illustrated).

Hence, the boundary portion K of the upper blade 61D and the lower blade 62D is established in a position higher than the flat portion 44Dd of the substantially M-shaped crimping portion 44D, thereby forming the recessed portion 44Dc of the substantially M-shaped crimping portion 44D in a position higher than the flat portion 44Dd when the conductor crimping portion 30*a* is deformed and crimped so as to become the substantially M-shaped crimping portion 44D.

Accordingly, even if downward burrs occur on both end portions in the width direction Y of the substantially M-shaped crimping portion 44D, it is possible to prevent the burrs from protruding further downward than the flat portion 44Dd.

With this arrangement, at the start of the operation by which the conductor crimping portion 30*a* is deformed, it is possible to deform the conductor crimping portion 30*a* into a desired crimping shape such as the substantially M-shaped crimping portion 44D without the occurrence of rotation, twisting, or the like in the conductor crimping portion 30*a* (refer to FIG. 11).

As a result, it is possible to reliably crimp and connect the conductor crimping portion 30*a* to the conductor tip portion 201*a* of the aluminum core wire 201.

Moreover, even when burrs occur on both end portions in the width direction Y of the substantially M-shaped crimping portion 44D, because the burrs can be prevented from protruding further downward than the flat portion 44Dd of the substantially M-shaped crimping portion 44D, it is possible to fit the substantially M-shaped crimping portion 44D inside predetermined dimensions by which insertion into the terminal insertion hole of the connector (not illustrated) is allowed.

Accordingly, the female type crimp terminal 10 to which the insulated wire 200 is connected can be reliably and smoothly inserted to the predetermined position inside the terminal insertion hole, achieving stable insertion characteristics.

Next, another example in which the conductor crimping portion 30*a* of the crimping portion 30 in the working example 4 is crimped so as to become the substantially M-shaped crimping portion 44D illustrated in FIG. 12 will be described.

Figure 12:
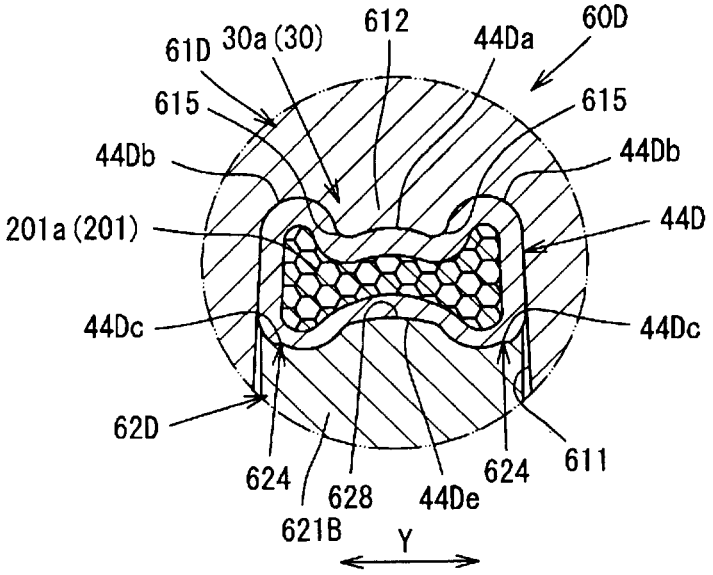
FIG. 12 is an enlarged cross-sectional view of a substantially M-shaped crimping portion formed in yet another crimping shape.

FIG. 12 is an enlarged cross-sectional view of the substantially M-shaped crimping portion 44D crimped into the crimping shape of the other example, specifically, an enlarged cross-sectional view of the substantially M-shaped crimping portion 44D as viewed from the frontward side X1 in the longitudinal direction X.

It should be noted that the configuration of the upper blade 61D and the lower blade 62D of the crimping device 60D that crimps the conductor crimping portion 30*a* of the crimping portion 30 has been described in the above-described working example 4, and thus details thereof will be omitted.

The aforementioned substantially M-shaped crimping portion 44D includes the protruding portions 44Da, 44Db and the recessed portion 44Dc described in the working example 4, and a concave portion 44De in which the center portion in the width direction Y on the lower surface side is indented into a concave cross section (refer to FIG. 12).

Specifically, the concave forming portion 628 for forming the concave portion 44De on the lower side outer periphery of the center portion in the width direction Y of the conductor crimping portion 30*a* is formed on the upper end portion of the center portion in the width direction Y of the protruding portion 621B of the lower blade 62D, protruding upward to the inside in the width direction Y of the outer peripheral contact portions 624, 624 of the protruding portion 621B, from the upper blade 61D of the crimping device 60D.

When the conductor crimping portion 30*a* of the crimping portion 30 is deformed and crimped so as to become the substantially M-shaped crimping portion 44D by the upper blade 61D and the lower blade 62D of the crimping device 60D, the lower side outer periphery of the center portion in the width direction Y of the conductor crimping portion 30*a* is pressed from below by the concave forming portion 628 of the protruding portion 621B of the lower blade 62D, thereby pressing the lower side outer periphery of the conductor crimping portion 30*a* toward the interior of the conductor crimping portion 30*a*.

With this arrangement, at the start of the operation by which the conductor crimping portion 30*a* is deformed, it is possible to deform the conductor crimping portion 30*a* into a desired crimping shape such as the substantially M-shaped crimping portion 44D without the occurrence of rotation, twisting, or the like in the conductor crimping portion 30*a* (refer to FIG. 12).

As a result, the contact surface area (contact length) of the conductor crimping portion 30*a* and the conductor tip portion 201*a* is larger, making it possible to ensure further stable conductivity.

Next, yet another example in which the conductor crimping portion 30*a* of the crimping portion 30 in the working example 4 is crimped so as to become the substantially M-shaped crimping portion 44D illustrated in FIGS. 13A and 13B will be described.

Figure 13A:
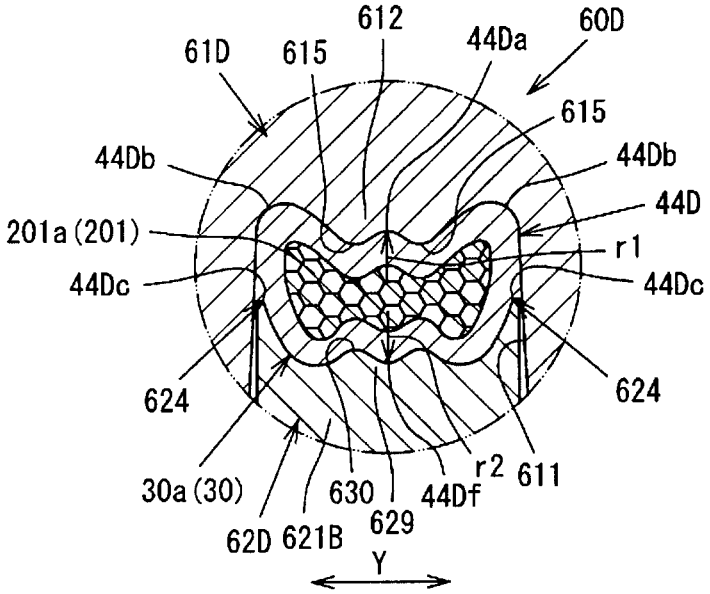
FIGS. 13A and 13B are enlarged cross-sectional views of a substantially M-shaped crimping portion formed in yet another crimping shape.
Figure 13B:
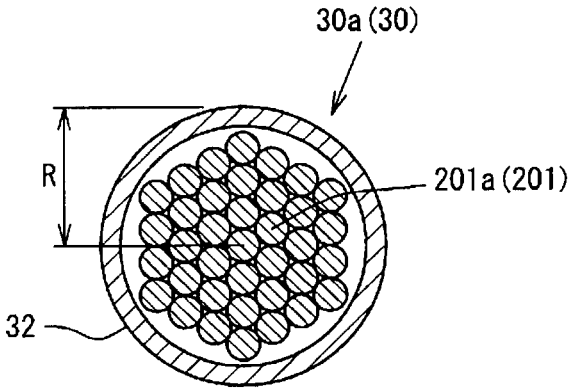
Figure 14A:
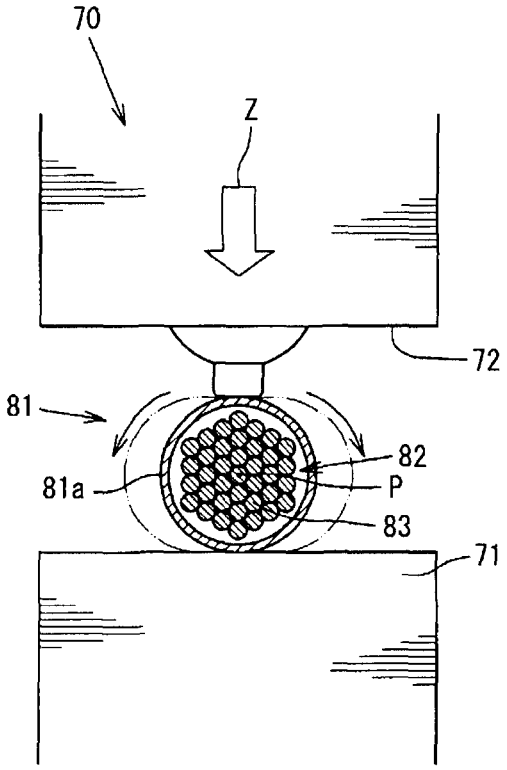
FIGS. 14A and 14B are explanatory views of a method for crimping a crimping portion by a conventional crimping device.
Figure 14B:
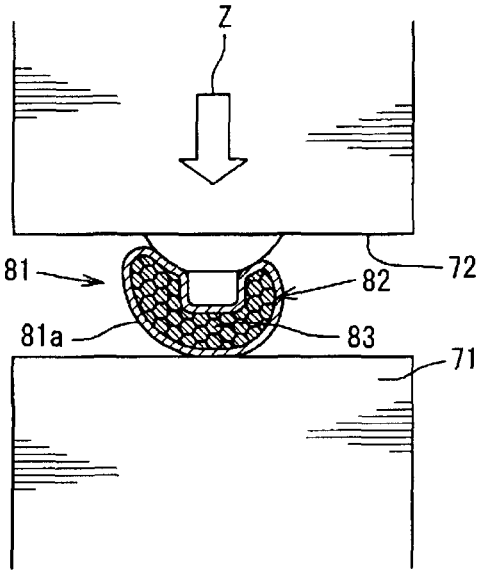

FIGS. 13A and 13B are enlarged cross-sectional views of the substantially M-shaped crimping portion 44D crimped into the crimping shape of the other example. Specifically, FIG. 13A is an enlarged cross-sectional view of the substantially M-shaped crimping portion 44D as viewed from the frontward side X1 in the longitudinal direction X, and FIG. 13B is an enlarged cross-sectional view of the conductor crimping portion 30*a* of the crimping portion 30 before crimping as viewed from the frontward side X1 in the longitudinal direction X.

It should be noted that the configuration of the upper blade 61D and the lower blade 62D of the crimping device 60D that crimps the conductor crimping portion 30*a* of the crimping portion 30 has been described in the above-described working example 4, and thus details thereof will be omitted.

The aforementioned substantially M-shaped crimping portion 44D includes the protruding portions 44Da, 44Db, and the recessed portion 44Dc described in the working example 4, and a protruding portion 44Df in which the center portion in the width direction Y on the lower surface side protrudes downward in a convex shape (refer to FIG. 13A).

A curvature radius r1 of the protruding portion 44Da and a curvature radius r2 of the protruding portion 44Df are established as R>r1 and R>r2 on the basis of a radius R of the conductor crimping portion 30*a* of the crimping portion 30 before crimping (refer to FIG. 13B).

Specifically, the two-mountain shaped protrusion forming portion 629 for forming the protruding portion 44Df on the lower side outer periphery of the center portion in the width direction Y of the conductor crimping portion 30*a* protrudes upward from the protruding portion 621B of the upper blade 61D of the crimping device 60D.

An outer peripheral contact portion 630 is formed in two locations on the upper end portion of the protrusion forming portion 629 at a predetermined spacing in the width direction Y so as to become a two mountain shape, and provided on the inside in the width direction Y of the outer peripheral contact portions 624, 624. The outer peripheral contact portions 630 are point-contacted to the lower side outer periphery of the conductor crimping portion 30*a* so as to be left-right symmetrical with respect to the reference plane.

When the conductor crimping portion 30*a* of the crimping portion 30 is deformed and crimped so as to become the substantially M-shaped crimping portion 44D by the upper blade 61D and the lower blade 62D of the crimping device 60D, the upper side outer periphery of the center portion in the width direction Y of the conductor crimping portion 30*a* is pressed from above by the penetration of the outer peripheral contact portions 615, 615 of the receiving groove 611.

Further, the lower side outer periphery of the center portion in the width direction Y of the conductor crimping portion 30*a* is pressed from below by the penetration of the outer peripheral contact portions 630, 630 of the protruding portion 621B of the lower blade 62D, thereby pressing the lower side outer periphery of the conductor crimping portion 30*a* toward the interior of the conductor crimping portion 30*a*.

With this arrangement, at the start of the operation by which the conductor crimping portion 30*a* is deformed, it is possible to deform the conductor crimping portion 30*a* into a desired crimping shape such as the substantially M-shaped crimping portion 44D even more so without the occurrence of rotation, twisting, or the like in the conductor crimping portion 30*a* (refer to FIG. 13A).

As a result, the contact surface area of the conductor crimping portion 30*a* and the conductor tip portion 201*a* is even larger, making it possible to ensure even further stable conductivity.

With regard to the correspondence between the configurations according to the present invention and the above described embodiments, the connection structure according to the present invention corresponds to the crimping connection structures 1, 1*a*, and 1*b* in the embodiments;

and similarly, the crimp terminal corresponds to the female type crimp terminal 10;

the crimping portion corresponds to the crimping portion 30, the conductor crimping portion 30*a*, and the cover crimping portion 30*b;* the terminal pressurization member corresponds to the lower blades 61, 62D, and the upper blades 62, 61D;

the conductor corresponds to the aluminum core wire 201; and the connector corresponds to the female type connector 3*a* and the male type connector 3*b*.

However, the present invention is not limited to the configurations in the aforementioned embodiments, and may be applied on the basis of the technological idea of the claims and may be carried out in any of various forms.

While the aforementioned embodiments describe the crimping connection structures 1, 1*a*, 1*b* in which the conductor crimping portion 30*a* of the crimping portion 30 is crimped to the conductor tip portion 201*a* of the aluminum core wire 201 of the insulated wire 200, the crimping method, and the crimping device 60A for crimping the same, the crimping method and crimping device according to the present invention may, for example, be applied to the crimping connection structures 1, 1*a*, 1*b* in which the cover crimping portion 30*b* of the crimping portion 30 is crimped so as to cover the cover tip portion 202*aa* of the insulating covering 202 of the electric wire tip portion 200*a*, and the crimping method and crimping device for crimping the same.

REFERENCE NUMBER

X: Longitudinal direction
Y: Width direction
Z: Crimping direction
K: Boundary portion
1, 1*a*, 1*b*: Crimping connection structure
3*a*: Female type connector
3*b*: Male type connector
10: Female type crimp terminal
30: Crimping portion
30*a*: Conductor crimping portion
30*b*: Cover crimping portion
32: Electric wire crimping portion
44A: Substantially U-shaped crimping portion
44B: Substantially elliptic-shaped crimping portion
44C: Substantially semicircle crimping portion
60A, 60B, 60C, 60D: Crimping device
61: Lower blade
62: Upper blade
61D: Upper blade
62D: Lower blade
611: Receiving groove
612: Protrusion forming portion
613: Outer peripheral contact portion
614: Outer peripheral contact portion
615: Outer peripheral contact portion
621: Protruding portion
621B: Protruding portion
622: Concave forming portion
623: Outer peripheral contact portion
624: Outer peripheral contact portion
625: Convex forming portion
626: Flat forming portion
627: Placing portion
628: Concave forming portion
629: Protrusion forming portion
630: Outer peripheral contact portion
200: Insulated wire
200*a*: Electric wire tip portion
201: Aluminum core wire
201*a*: Conductor tip portion
202: Insulating covering
202*a*: Cover tip portion
300: Connector housing

The invention claimed is:

1. A method for crimping a connection structure, the method comprising:

inserting an electric wire tip portion of an insulated wire, the electric wire tip portion having been formed by exposing a conductor by peeling off an insulating covering of a tip side, into a crimping portion of a hollow cross section that comprises an internal space that allows insertion of the electric wire tip portion in a crimp terminal;

deforming the crimping portion by moving a pair of terminal pressurization members in a crimping direction; and crimping and connecting the insulated wire and the crimp terminal, wherein the pair of terminal pressurization members include plural outer peripheral contact portions, the outer peripheral contact portions contacting an outer periphery of the crimping portion in a perpendicular cross section that is perpendicular to a longitudinal direction and a crimping direction of the crimp terminal, the plural outer peripheral contact portions contain first outer peripheral contact portions and second outer peripheral contact portions, the first outer peripheral contact portions being of a first terminal pressurization member of the pair of the terminal pressurization members and are disposed at a spacing in a width direction of the crimping portion in the perpendicular cross section, the first outer peripheral contact portions are disposed so that contacting locations of the outer periphery of the crimping portion and the first outer peripheral contact portions are symmetrical with respect to a reference plane formed by the longitudinal direction and the crimping direction when the pair of the terminal pressurization members is moved in the crimping direction to deform the crimping portion, the second outer peripheral contact portions being of a second terminal pressurization member of the pair of the terminal pressurization members and are disposed to point-contact the outer periphery of the crimping portion in the perpendicular cross section, the second outer peripheral contact portions are disposed at a spacing in the width direction of the crimping portion in the perpendicular cross section, the second outer peripheral contact portions are disposed so that contacting locations of the outer periphery of the crimping portion and the second outer peripheral contact portions are symmetrical with respect to the reference plane when the crimping portion is deformed, and the second outer peripheral contact portions of the second terminal pressurization member are disposed inward of the first outer peripheral contact portions of the first terminal pressurization member, and before the deforming the crimping portion by moving the pair of terminal pressurization members, the first outer peripheral contact portions contact corresponding plural points of the upper outer periphery of the crimping portion, and the second outer peripheral contact portions contact corresponding plural points of the lower outer periphery of the crimping portion.

2. The method for crimping the connection structure according to claim 1, wherein the first terminal pressurization member comprises a receiving groove having the first outer peripheral contact portions; and the second terminal pressurization member is configured in a convex shape that is narrower than the receiving groove.

3. The method for crimping the connection structure according to claim 2, wherein movement in the crimping direction of the terminal pressurization members causes the second terminal pressurization member to press the crimping portion to the receiving groove and causes the crimping portion to decrease in diameter in the width direction by the receiving groove.

4. The method for crimping the connection structure according to claim 2, wherein a third outer peripheral contact portion disposed inward of the first outer peripheral contact portions of the first terminal pressurization member disposed at a spacing is provided on the receiving groove.

5. The method for crimping the connection structure according to claim 1, wherein the crimping portion comprises a conductor crimping portion that is crimped to a conductor tip portion of the conductor exposed from the tip of the insulating covering of the insulated wire.

6. The method for crimping the connection structure according to claim 1, wherein the deforming the crimping portion includes making a width of the terminal pressurization members smaller than an outward form of the terminal before the crimping.

7. The method for crimping the connection structure according to claim 1, wherein the second outer peripheral contact portions are formed on an upper end surface of the second terminal pressurization member and have a two mountain shape.

8. The method for crimping the connection structure according to claim 7, wherein the first outer peripheral contact portions are formed on a lower end surface of the first terminal pressurization member and have a two mountain shape.

9. The method for crimping the connection structure according to claim 7, wherein the first outer peripheral contact portions are formed on each of the lower end side inner wall portions of both side portions of the first terminal pressurization member, and the distance in the width direction of the crimping portion in the perpendicular cross section between the first outer peripheral contact portions formed on each of the lower end side inner wall portions of both side portions of the first terminal pressurization member is greater than the distance between the second outer peripheral contact portions formed on an upper end surface of the second terminal pressurization member and having a two mountain shape.

10. The method for crimping the connection structure according to claim 1, wherein the first outer peripheral contact portions are formed on each of the lower end side inner wall portions of both side portions of the first terminal pressurization member.

* * * * *